United States Patent [19]

Satomi et al.

[11] 4,218,130

[45] Aug. 19, 1980

[54] METHOD FOR CONTROLLING A COPYING APPARATUS ADAPTED TO PRINT IMAGES ON OPPOSITE SURFACES OF A COPY SHEET

[75] Inventors: Toyokazu Satomi, Yokohama; Yutaka Koizumi, Kawasaki; Seiichi Miyakawa, Nagareyama; Isao Nakamura, Tokyo; Yasuhiro Tabata, Kawasaki; Tamaki Kaneko, Fujisawa, all of Japan

[73] Assignee: Ricoh Co., Ltd., Japan

[21] Appl. No.: 931,398

[22] Filed: Aug. 4, 1978

[30] Foreign Application Priority Data

Aug. 9, 1977 [JP] Japan ..... 52-94646
Aug. 31, 1977 [JP] Japan ..... 52-103592

[51] Int. Cl.[2] ..... G03G 15/00

[52] U.S. Cl. ..... 355/14 R; 355/24; 355/25

[58] Field of Search ..... 355/14, 8, 11, 23–26

[56] References Cited

U.S. PATENT DOCUMENTS

| | | | |
|---|---|---|---|
| 3,980,406 | 9/1976 | Lang | 355/24 |
| 4,017,173 | 4/1977 | Komori et al. | 355/26 X |
| 4,099,150 | 7/1978 | Connin | 355/23 X |
| 4,123,155 | 10/1978 | Hubert | 355/26 |

*Primary Examiner*—R. L. Moses
*Attorney, Agent, or Firm*—McGlew and Tuttle

[57] ABSTRACT

In successively copying a plurality of continuous pages of a book original by means of a copying apparatus adapted to print images of the pages on opposite surfaces of each copy sheet, a printing operation is controlled in such a manner that a series of processes including, illumination of the pages, charging and exposing of a photosensitive drum, developing, fixing and transfer printing of visible images, and ejection of printed copy sheets is automatically performed, if the book original is opened at desired pages and placed on an original placing glass plate of the copying apparatus in a normal condition in which the top of the book original is remote from the operator. With the operator merely turning the pages, the control method enables the production of a bundle or bundles of duplicate copies of the pages of the same order and arrangement as the book original, regardless of whether the book original is bound on the left side or on the right side and whether the first and last pages to be copied have even numbers or odd numbers. In copying the adjacent two pages, two pages can be copied in separate copying processes or in a single continuous copying process for the two pages.

13 Claims, 57 Drawing Figures

FIG. 1(a)
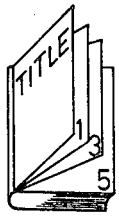
FIG. 1(b)
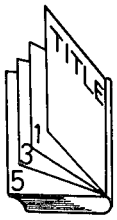
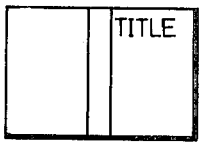
FIG. 1(c)
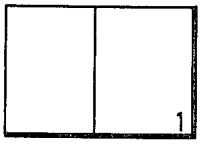
FIG. 1(d)
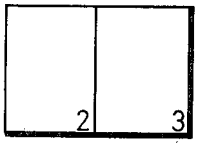
FIG. 1(e)
FIG. 2
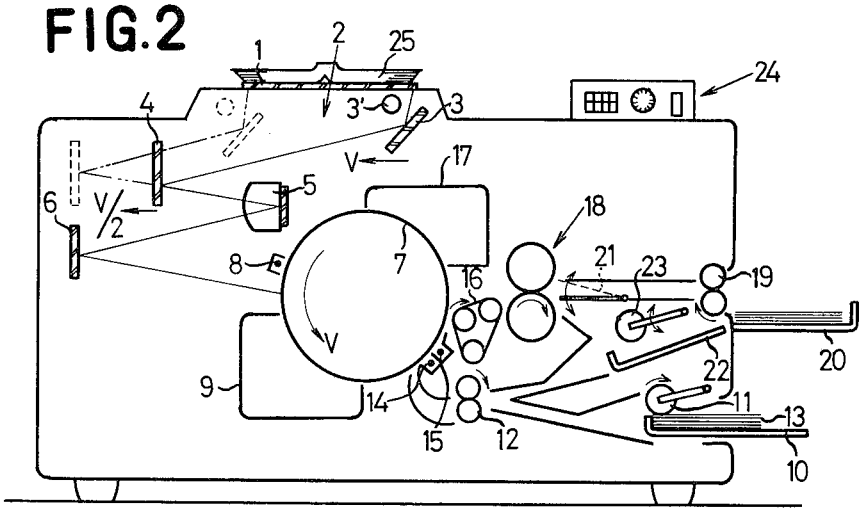

(a)

(b)

From an Odd-Number Page to an Odd-Number Page

From an Odd-Number Page to an Even-Number Page

From an Even-Number Page to an Odd-Number Page

From an Even-Number Page to an Even-Number Page

From an Odd-Number Page to an Odd-Number Page

From an Odd-Number Page to an Even-Number Page

From an Even-Number Page to an Odd-Number Page

From an Even-Number Page to an Even-Number Page

From an Even-Number Page to an Odd-Number Page

From an Even-Number Page to an Even-Number Page

From an Even-Number Page to an Odd-Number Page

From an Even-Number Page to an Even-Number Page

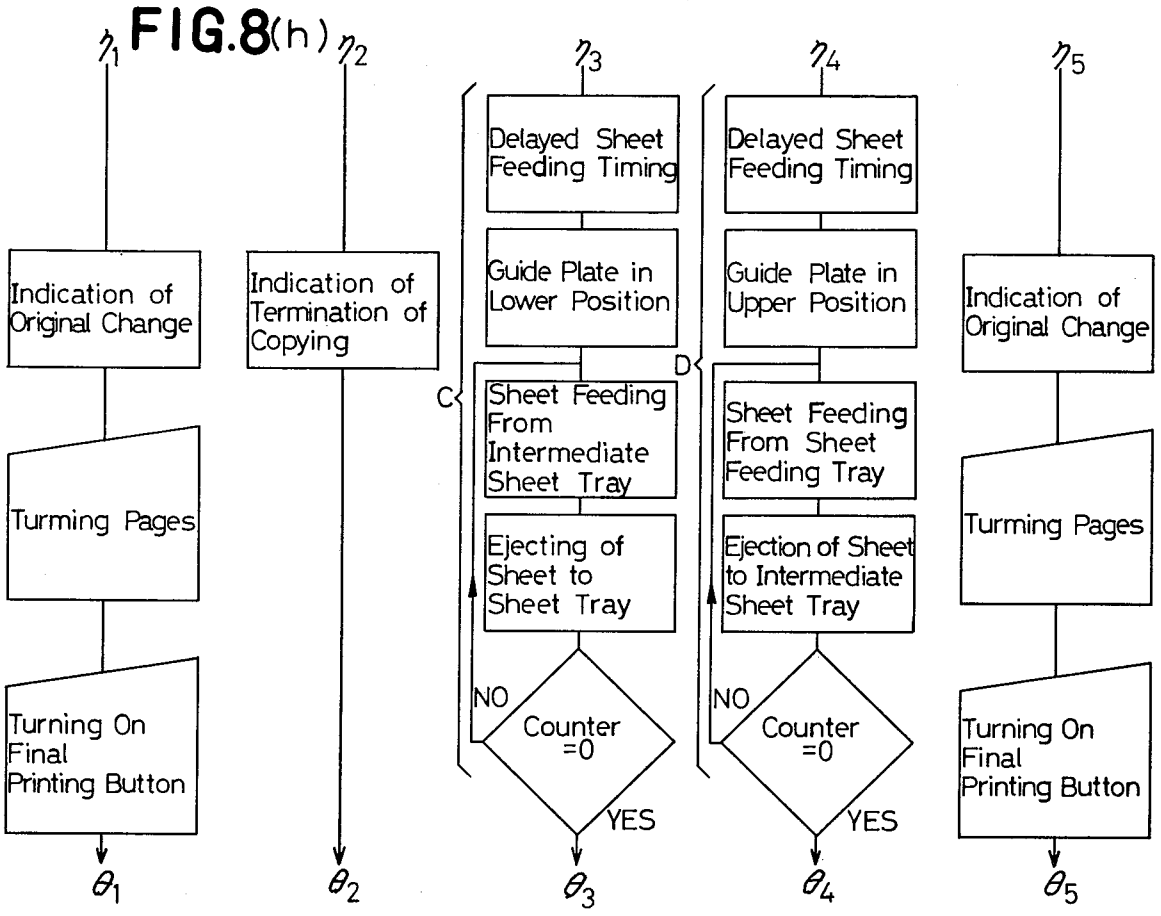
FIG.8(h)
$\eta_1$
Indication of Original Change
Turning Pages
Turning On Final Printing Button
$\theta_1$
$\eta_2$
Indication of Termination of Copying
$\theta_2$
$\eta_3$
Delayed Sheet Feeding Timing
Guide Plate in Lower Position
Sheet Feeding From Intermediate Sheet Tray
Ejecting of Sheet to Sheet Tray
Counter =0
NO
YES
$\theta_3$
C
$\eta_4$
Delayed Sheet Feeding Timing
Guide Plate in Upper Position
Sheet Feeding From Sheet Feeding Tray
Ejection of Sheet to Intermediate Sheet Tray
Counter =0
NO
YES
$\theta_4$
D
$\eta_5$
Indication of Original Change
Turning Pages
Turning On Final Printing Button
$\theta_5$ From an Odd-Number Page to an Odd-Number Page From an Odd-Number Page to an Even-Number Page From an Even-Number Page to an Odd-Number Page From an Even-Number Page to an Even-Number Page From an Odd-Number Page to an Odd-Number Page From an Odd-Number Page to an Even-Number Page From an Even-Number Page to an Odd-Number Page From an Even-Number Page to an Even-Number Page

METHOD FOR CONTROLLING A COPYING APPARATUS ADAPTED TO PRINT IMAGES ON OPPOSITE SURFACES OF A COPY SHEET

BACKGROUND OF THE INVENTION

This invention relates to a method for controlling a copying apparatus which is adapted to print images on opposite surfaces of a copy sheet.

In this type of copying apparatus, an image of an original is first printed on one surface of a copy sheet in a usual copying process (by transfer printing and fixing), and such copy sheet is returned to an original sheet feeding device or diverted to a second sheet feeding device by actuating single-surface/double-surface copying switching means (such as a switching guide plate) mounted in a duplicate copy ejecting passage, so that the copy sheet is turned inside out and fed to a copying station again to print an image on the other surface or under side thereof.

When this type of copying apparatus is used for copying several continuous pages or the whole pages of a book original, difficulties are encountered in producing a bundle or bundles of duplicate copies of the desired pages of the book original which has the same order and arrangement of pages as the book original. There are three factors concerned in the occurrence of these difficulties, such three factors being complicated and involved with one another.

The first factor is the construction of a book original itself. Since the pages of a book cannot be separated into discrete sheets, a book original must be opened at desired pages and the pages must be turned manually when copying is carried out like a sheet original, a book original has top and bottom, so that copying of pages on opposite surfaces of a copy sheet should be carried out in such a manner that no pages are copied upside down. Also, there are two types of binding in a book original or a right-side binding and a left-side binding [See FIGS. 1(*a*) and 1(*b*)]. A book original is arranged in the order of pages, so that copying must be carried out by accurately following the pages and there should be no confusion in the order in which the pages are copied. Since a book original has binding allowances in the adjacent edge portions of the continuous two pages, a copy sheet having continuous pages of a book original printed on opposite surfaces thereof must have its binding allowances on the same edge side of the opposite surfaces of the copy sheet.

The second factor is the construction of a copying apparatus itself. In a copying apparatus of the type which is generally referred to as a slit-exposure type copying apparatus, a photosensitive member of the copying apparatus is exposed to an optical image of a book original by scanning the book original, which is placed on an original placing plate, by a light flux moved from one end of the original placing plate to the other end thereof or in one direction. Therefore, when it is desired to illuminate at all times the second page of the two pages of a book original placed on the original placing plate, it is necessary either to turn the book original upside down depending on whether the book original to be copied is bound on the right side or on the left side, or to slightly move the book original manually after the pages thereof are placed on the original placing plate. When a book original is handled in this way, there is the danger that confusion is caused in the order of pages to be printed. In a copying apparatus adapted to print images on opposite surfaces of a copy sheet, switching means, as a switching guide plate, must be provided, so that switching between printing of an image only on one surface of a copy sheet and printing of images on opposite surfaces of a copy sheet can be effected by such switching means.

The third factor is a requirement which must be met when the operator performs printing of pages of a book original. The following four combinations come to mind with regard to the pages which are desired to be copied: [See page 4 or pages 5(a) to 5(d) ]:

(1) A combination in which an initial page is an odd number and a terminating page is also an odd number (odd-odd);

(2) A combination in which an initial page is an odd number and a terminating page is an even number (odd-even);

(3) A combination in which an initial page is an even number and a terminating page is an odd number (even-odd); and (4) A combination in which an initial page is an even number and a terminating page is also an even number (even-even).

When it is desired to copy a diagram or illustration of a book original, such diagram or illustration may spread over the two adjacent pages of the open book original. When this is the case, one portion of the diagram or illustration should be copied on the underside of a preceding copy sheet and the other portion thereof should be copied on the upper surface of the next following copy sheet.

Heretofore, proposal has been made to overcome the aforementioned difficulties by using a copying apparatus wherein the original placing glass plate is divided into two sections, one section being adapted to receive thereon an odd number page of a book original and the other section being adapted to receive thereon an even number page thereof. However, when this type of copy apparatus is used, open pages of a book original should be illuminated separately, and the movement of the scanner must start at the bound portion of a book original. This results in the apparatus becoming complex in construction. Moreover, the operation is troublesome because the manner in which a book original is placed on the original placing glass plate with respect to its top and bottom should be reversed depending on whether the book original to be handled is bound on the right side or on the left side. Moreover, no means is provided in this copying apparatus for arranging the printed copy sheets in an orderly manner when continuous pages of a book original are copied in respect copying operations.

SUMMARY OF THE INVENTION

This invention has as its object the provision of a method for controlling a copying apparatus adapted to print images on opposite surfaces of a copy sheet, which enables a desired bundle or bundles of duplicate copies to be produced without error and with relative ease, by simplifying the handling of a copying apparatus of the aforementioned type and a book original which is usually troublesome due to the fact that the aforementioned complicated requirements have to be met.

The outstanding feature of the present invention is that the aforementioned object can be accomplished by placing a book original on an original placing glass plate in such a manner that the book original is opened at desired pages and disposed with its spine at right angles to the direction of movement of the illuminating scanner and its top remote from the operator, regardless of whether the book original is bound on the right side or on the left side.

BRIEF DESCRIPTION OF THE DRAWINGS

FIG. 1 is a view in explanation of a book bound on the left side and a book bound on the right side;

FIG. 2 is a schematic view of a copying apparatus in which a first embodiment of the control method according to the invention is adapted to be carried into practice;

FIG. 3(*b*) is a block diagram of the basic components of the control device;

DESCRIPTION OF THE PREFERRED EMBODIMENTS

Figure 3:
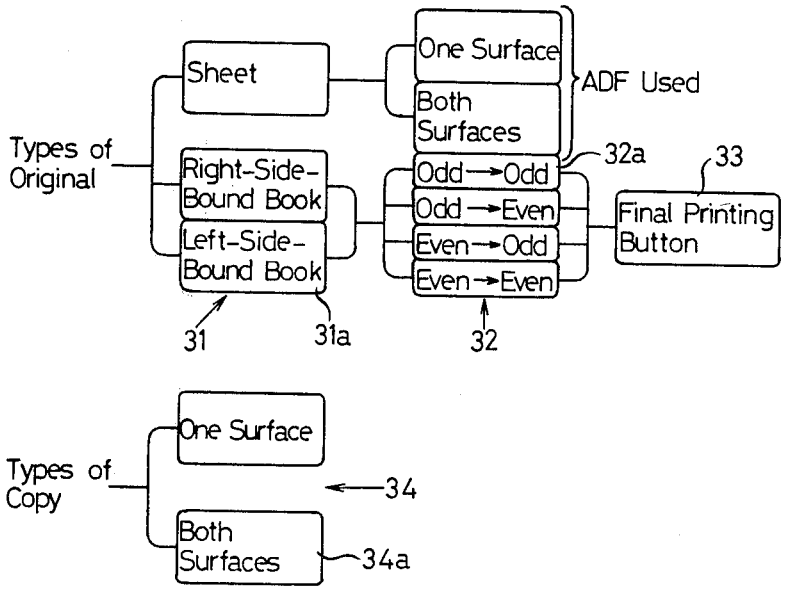
FIG. 3(*a*) shows an example of operating buttons of the copying apparatus shown in FIG. 2.
Figure 3:
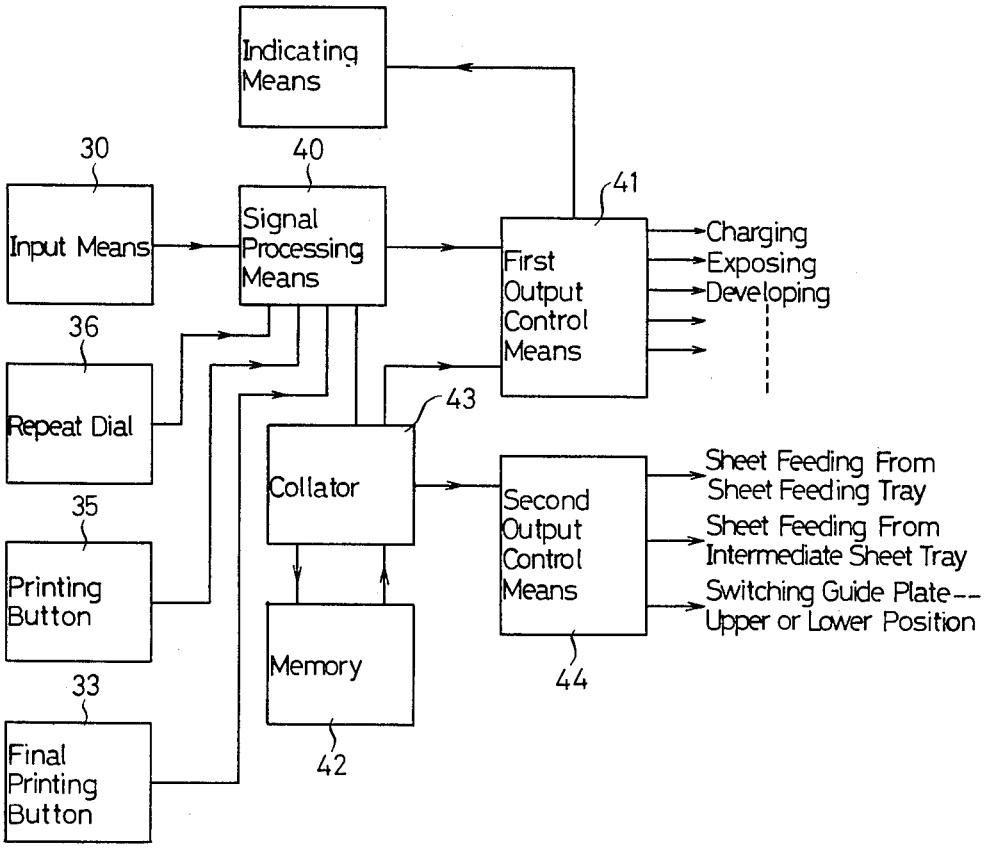

FIGS. 1(*a*) and 1(*b*) show a book original bound on its left side and a book original bound on its right side respectively. The left-side-bound book original is shown in FIGS. 1(*c*) to 1(*e*) with its pages open and located in a normal position, FIG. 1(*c*) showing the book original with its front cover and back cover facing upwardly and FIGS. 1(*d*) and 1(*e*) showing it with its pages facing upwardly. Generally, the majority of books are bound such that the odd-number pages are located on the same side as the front cover. Therefore, for the sake of covenience, only such books which have odd-number pages on the same side of the front cover will be dealt with in this invention.

The handling of a book original and the manipulation of a copying apparatus are very simiplified, if the book original is placed on the original placing plate without regard to the side on which the book original is bound and without turning it upside down. In many types of copying apparatus of the slit exposure type, the scanner of the illuminating optical system continuously move in one direction and then return to its original position after travelling a predetermined distance. Therefore, some measures must be taken to illuminate the pages of a book original in a desired order. In the first embodiment of the present invention, the end is attained by controlling the timing of copy sheet feeding, without resorting to a complicated process of changing the starting position of the illuminating scanner. Since copies are printed on opposite surfaces of a copy sheet, control of copy sheet feed timing must also be effected with respect to the intermediate copy sheet feeding determine. Also, control of the control guide plate to devide whether printing of an original is carried out on one surface only of a copy sheet or on opposite surfaces thereof is effected depending on to what one of the aforesaid combinations of odd-odd, odd-even, even-odd and even-even the desired pages to be copied belong.

FIG. 2 shows a copying apparatus adapted to print copies on opposite surfaces of a copy sheet, in which the first embodiment of this invention can have application. To facilitate the understanding of the present invention, the construction and operation of the copying apparatus will be briefly described An original placing glass plate 1 is scanned by an illuminating optical system 2 from its right end to its left end. A first mirror 3 of the illuminating optical system 2 moves, together with a lamp 3, at a velocity V, and a second mirror 4 moves away from an in-mirror lens (a mirror disposed behind a half lens) 5 at a velocity of V/2, so as to expose a photosensitive drum 7 to an optical image of the original by slitexposure through a fixed mirror 6. Before being exposed in this way, the photosensitive drum 7 is charged by means of a charger 8, and rotates in the direction of an arrow at a velocity V. A book original 25 is placed on the original placing glass plate 1 in such a manner that its pages are open, the pages to be copied are in contact with the plate 1, the top of the book original is remote from the operator and the spine of the book original is at right angles to the direction of scanning movement of the optical system. Thus, when the book original 25 is a left-side-bound book, the page of the smaller number is disposed on the home position side of the illuminating scanner. Therefore, when the book original 25 is a left-side-bound book the illumination scanner is moved from a page of a smaller number to a page of a larger number, and a latent image of the page of the smaller number is first formed on the photosensitive member 7 and then a latent image of the page of the larger number is formed thereon. These latent images are developed into visible images by means of a toner in a developing station 9. Alternatively, copying processes including illumination, exposure, developing, etc., can be performed only with regard to one of the open two pages. In this case, although a single visible image is desired to be formed on the photosensitive drum, the scanner may continously move along the open two pages.

Meanwhile a copy sheet feeding roller 11 of a copy sheet feeding device 10 begins to rotate, and a copy sheet is fed to a transfer-printing sheet is fed to a transfer-printing station from a stack of copy sheets 13 in timed relation to the movement of the visible image or a desired one of the aforesaid visible images which correspond to one of the two pages to be copied. In the transferprinting station, the visible image is printing by means of a transferprinting charger 14 on the copy sheet which is separated by a separating device 16 from the drum 7 under the action of a separating charger 15. The photosensitive drum 7 is cleaned by a cleaning device 17 and charged again by the charger 8. The separated copy sheet has a printed image thereon fixed by means of a fixing device 18, and is passed through a pair of ejecting rollers 19 to be ejected onto a duplicate copy tray 20 when an image is printed on one surface of the copy sheet alone. The copy sheet ejected in this case is arranged such that the surface on which the image is printed faces upwardly. On the other hand, when images are printed on opposite surfaces of the copy sheet, the copy sheet is guided by a switching guide plate 21 mounted midway in the copy sheet ejecting passage and forwarded to an intermediate copy sheet feeding device 22 and returned to the copy sheet feeding passage by a second copy sheet feeding roller 23. The returned copy sheet is again fed by rollers 12 to the transfer-printing station. The feeding of the copy sheet to the transfer-printing station is timed nicely to the movement to the transfer-printing station of the image on the photosensitive drum which corresponds to the other page. The image of the other page is printed on the underside of the copy sheet, and separated from the photosensitive drum 7 to be finally ejected onto the copy sheet receiving tray 20. The copy sheet ejected onto the tray 20 after having images printed on opposite surfaces thereof is turned upside down during the printing process, as compared with the copy sheet ejected onto the tray 20 after having an image printed on one surface thereof.

As shown in FIG. 3(*a*), an instrument panel 24 (See FIG. 2) has mounted thereon a number of operating switches. Of all the switches mounted on the panel 24, the switches which are directly related to the present invention include a binding side (left or right) selecting switch 31 serving concurrently as an original type (sheet or book) selecting switch, a page classification selecting switch 32 which selects one of the aforesaid four combinations of "Odd-Odd", "Odd-Even", "Even-Odd" and "Even-Even", and a switch 33 which is depressed when the last page of a series of pages required is copied. 34 refers to a single-surface/double-surface printing change-over switch.

FIG. 3(*b*) shows the basic components of the control device. Signals from a final printing button 33, a printing button 35, a repeat dial 36 and other input means 30 are supplied to a signal processing means 40. The input means 30 include the binding side selection switch 31, page classification switch 32, single-surface/double-surface printing change over switch 34, a copy sheet size selecting switch and other switches. The single processing means 40 performs the functions of amplification, counting and damping, and gives instructions, through a first output control means 41, to carry out a series of copying processes which include charging, exposing, developing, etc., upon receipt of instructions from the printing button 35 or the final printing button 33. 42 designates a memory which stores thereon information on the copy sheet feeding timing of the main copy sheet feeding device 10 and intermediate copy sheet feeding device 22, described with reference to FIG. 2, the direction in which the switching guide plate 21 is to be directed, a final printing step and other contents. If the printing button 35 is depressed, one of programs A to F (See the table below) to be carried out is taken out of a collator 43 and supplied to a second output control means 44. Each of the programs selected is shown in the table below.

Table

| | Main Copy Sheet Feeding Timing | Position of Switching Plate | Intermediate Copy sheet Feeding Timing | Ejection to Tray |
|---|---|---|---|---|
| A | Late | Lower | | O |
| B | Early | Upper | | None |
| C | | Lower | Late | O |
| D | Late | Upper | | None |
| E | | Lower | Early | O |
| F | Early | Lower | | O |

The control method provided by the invention enables the production of a bundle of copy sheets which are arranged in the order of pages merely by manipulating the pushbuttons shown in FIG. 3 to give instructions on the binding side, page classification, etc., and by turning the pages manually when necessary. This control method will be described in a concrete form by referring to FIGS. 4 to 8.

The copying of a book original bound on its left side a shown in FIG. 4 will first be described.

Copying of Original from an Odd-Number Page to an Odd-Number Page

Figure 4:
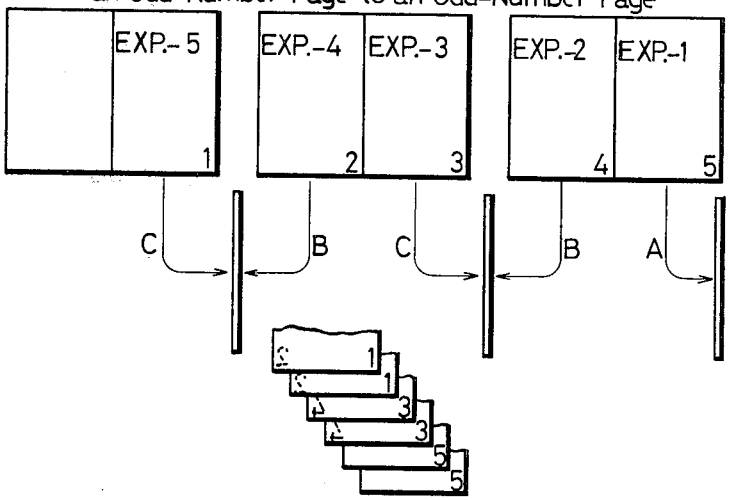
FIGS. 4(*a*) to 4(*d*) are views in explanation of the manner in which copying of pages of a book original bound on its left side is carried out by the control method according to the invention.
Figure 4:
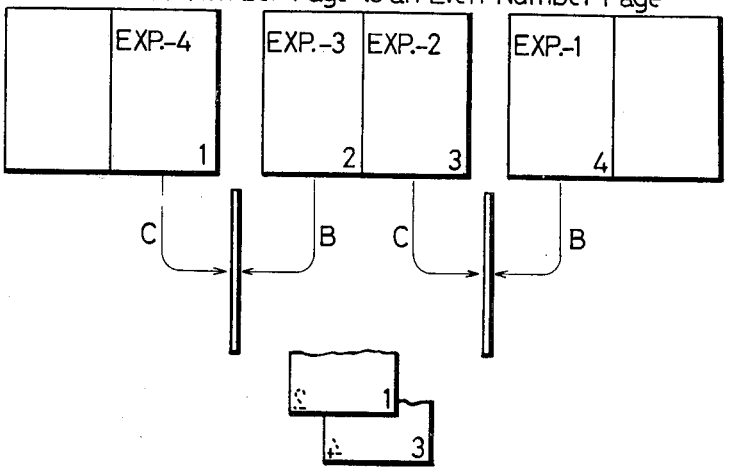
Figure 4:
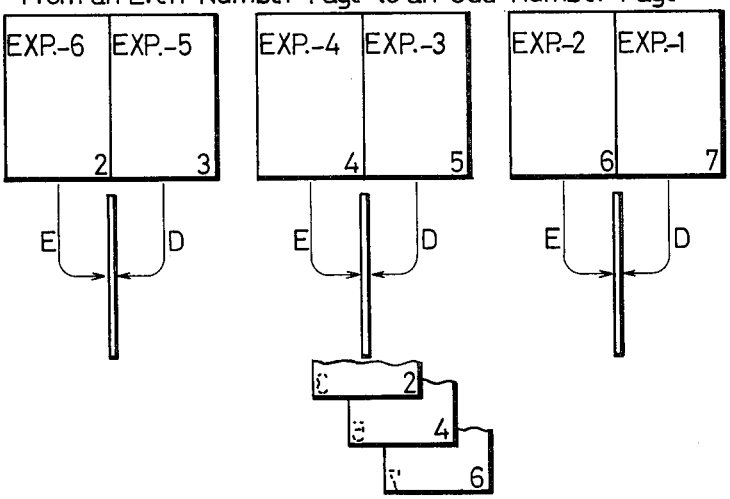
Figure 4:
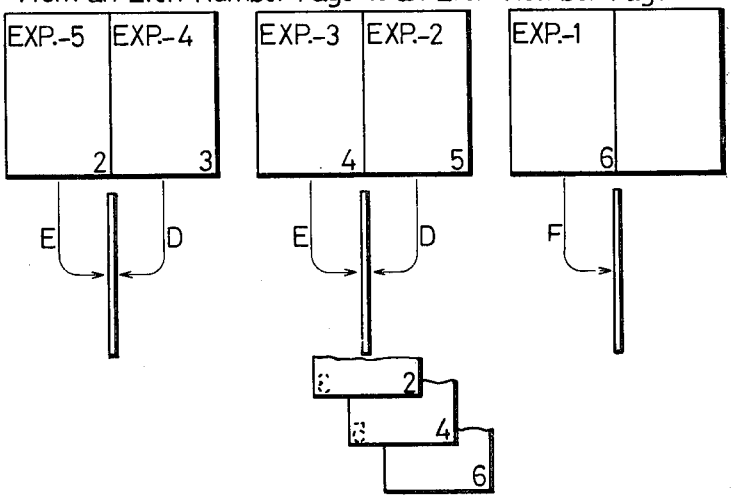

FIG. 4(*a*) shows an example in which bundles of duplicate copies of pages 1 to 5 are obtained. First, buttons "book-left-bound", "odd-odd" and "double surface" 31*a*, 32*a* and 34*a* respectively shown in FIG. 3 are depressed, and a repeat dial 36 is set at "2". Meanwhile a book is opened at pages 4 and 5 including the final page, and placed on the original placing glass plate 1 of the copying apparatus shown in FIG. 2 in such a manner that the top of the book is remote from the operator or in a normal state. The signal processing means 40 of the copying apparatus has been given with instructions regarding the binding-side, page classification and repeat print number, and the copying apparatus is now waiting for the printing button 35 to be depressed [Processes (1)–(4) of FIG. 8].

Upon depression of the printing button 35, the signal processing means 40 supplies to the collator 43 signal which is commensurate with the set conditions. Control programs A+B stored beforehand in the memory 42 are selected and transferred to the first and second output control means 41 and 44. By the first control means 41, ordinary process steps of charging, exposing, developing, etc. performed by the copying apparatus is controlled. In this case, the illumination scanner is moved along the open two pages from the right side (page 4) to the left side (page 5) of the original shown in FIG. 2. In FIG. 4, EXP.-1, EXP.-2... indicate the order in which the pages of the book are to be printed.

In the program A shown in FIG. 8, page 5 is exposed and developed before page 4 is treated. That is, although the scanner continuously moves along pages 4 and 5, transfer-printing is performed only with respect to the image of page 5. The copy sheet feeding timing is delayed for a period of time corresponding to the time required for moving of the scanner along the page 4 of the original, before the copy sheet feeding roller 11 is actuated (step a in FIG. 8). A copy sheet fed from the main copy sheet feeding device 10 has an image of page 5 printed thereon and fixed. Substantially at the same time, the switching quide plate 21 is moved to a lower position (shown in solid lines in FIG. 2) (step b in FIG. 8). Therefore, the copy sheet after being fixed is ejected onto the copy sheet tray 20 (step d in FIG. 8). This is repeated until the content of the repeat counter becomes zero or twice in this example (steps c–e in FIG. 8). Thus two copy sheets each having an image of page 5 printed on one surface thereof are stacked on the copy sheet tray 20 in such a manner that the image bearings surfaces face upwardly.

Then, according to the program B, page 4 of the original is exposed and developed, and a copying operation for page 4 is performed. Since page 4 is located on the home position side of illumination scanner, copy sheet feeding is expedited in timing (step f in FIG. 8). A copy sheet is fed from the main copy sheet feeding device 10 in synchronism with the movement of toner image of page 4 to the transfer-printing station, so that the image of page 4 is printed on the copy sheet. After the image is fixed, the copy sheet is introduced into the intermediate copy sheet feeding device 22 (step i in FIG. 8). At this time, the switching guide plate 21 is moved to its upper position (shown in broken lines in FIG. 2) (step g in FIG. 8). This is repeated until the content of the repeat counter becomes zero or twice (steps h to j in FIG. 8), so that two copy sheets, each having an image of page 4 printed on one surface thereof, are stacked on the intermediate copy sheet tray 22 in such a manner that the surfaces of the copy sheets on which images of page 4 are printed face upwardly. An original changing indication is given upon completion of illumination of the original in the program B. Then the operator turns the page, and places pages 2 and 3 on the original placing glass plate 1 in the same manner as described hereinabove.

Depression of the printing button 35 selects control programs C+B. In the program C, the scanner is moved along page 3 and 4, and page 3 is illuminated and developed, so that a copying operation is performed with respect to page 3. One of the copy sheets on which the images of page 4 are printed is fed from the intermediate copy sheet tray 22. In this case, since the page 3 of the original is located in a position remote from the home position of the scanner, the copy sheet feeding timing is delayed (step a in FIG. 8). The copy sheet which has images of pages 4 and 3 printed on opposite surfaces thereof is ejected onto the copy sheet tray 20 (step c'–e' in FIG. 8) by being guided by the switching guide plate 21 which is changed to its lower position (shown in solid lines) (step b' in FIG. 8). This is repeated until the content of the repeat counter becomes zero (steps c'–e' in FIG. 8). Thus two copy sheets having the images of pages 3 and 4 printed on opposite surfaces thereof are stacked, with the surfaces having the images of page 3 facing upwardly, on two copy sheets of page 5 already stacked on the copy sheet tray 20. Then the program B is carried out in the same manner as described hereinabove, and two copy sheets each having an image of page 2 on one surface thereof are stacked on the intermediate copy sheet tray 22. Upon completion of exposure in the program B, an original changing indication is given.

Then the pages are turned, and the fly leaf and page 1 are placed on the original placing glass plate 1, and the final printing button 33 shown in FIG. 3(*b*) is depressed. If the final printing button 33 is depressed, then only the former half of the programs C+B or the program C alone is carried into practice and an indication is given of the completion of copying. Therefore, images of page 1 are printed on blank surfaces of the copy sheets which each have the image of page 2 printed on one surface thereof, and the copy sheets having the images of pages 1 and 2 printed thereon are ejected onto the copy sheet tray 20.

The copy sheets stacked in a pile on the copy sheet tray 20 after the final program has been carried out are shown in FIG. 4(*a*). It will be seen that, if these copy sheets are sorted by a collator of sorter, two bundles of copy sheets printed on opposite surfaces thereof with pages 1 to 5 arranged in the correct order can be obtained.

Copying of Original from an Odd-Number Page to an Even-Number Page

FIG. 4(*b*) shows an example in which a bundle of copy sheets having images of pages 1 to 4 on opposite surfaces thereof. In this example, if an "Odd-Even" button of the page classification selecting switch 32 is depressed, a process (5) shown in FIG. 8 is started.

Depression of the printing button 35 causes program B to be carried out. An image of page 4 is printed on a copy sheet which is forwarded to the intermediate copy sheet tray 22. The pages are turned to place pages 2 and 3 on the original placing glass plate 1. Upon depression of the printing button 35, programs C+B are carried out. The scanner is moved along pages 2 and 3, page 3 is illuminated and a copying operation is performed with regard to page 3, so that an image of page 3 is printed on a blank surface of the copy sheet fed from the intermediate copy sheet tray to the transfer-printing station. The copy sheet having the images of pages 3 and 4 printed on opposite surfaces thereof is ejected onto the copy sheet tray 20, and a copy sheet having an image of page 2 printed on one surface thereof is introduced into the intermediate copy sheet tray 22. Then the pages are turned so that the fly leaf and page 1 will be placed on the original placing glass plate 1, and the final printing button 33 is depressed. The program C alone is carried out, and a bundle of copy sheets having the images of pages 1 to 4 printed on opposite surfaces of two copy sheets with the pages arranged in the correct order as shown in FIG. 4(*b*) can be obtained.

Copying of Original from an Even-Number Page to an Odd-Number Page

FIG. 4(*c*) shows an example in which a bundle of duplicate copies of page 2 to page 7 is obtained. By depressing the "Even-Odd" button, a process (6) shown in FIG. 8 is carried out.

If the printing button 35 is depressed, then programs D+E are carried into practice. The program D is similiar to the program B except that in step f'the copy sheet feeding timing is delayed for page 6 alone. The program E is similar to the program C except that the copy sheet feeding timing is advanced in step a'. By carrying the programs D+E into practice, page 7 and page 6 are printed on opposite surfaces of a copy sheet, and the copy sheet thus having the images of page 7 and page 6 is ejected. Then the pages of the original are turned and the printing button 35 is depressed. This carries the programs D+E into practice, so that page 5 and page 4 are printed on opposite surface of another copy sheet, and the copy sheet thus having the images of page 5 and page 4 is ejected. Thereafter the pages of the original are turned again and the final printing button 33 is depressed. As a result, the programs D+E are carried into practice, and page 3 and page 2 are printed on opposite surfaces of still another copy sheet, so that the copy sheet thus having the images of page 3 and page 2 is ejected. After the copy sheets are ejected, a copying termination indication is given. a bundle of duplicate copies obtained is arranged in the correct order of pages, although the pages of the bundle face opposite to the corresponding pages of the original.

Copying of Original from an Even-Number Page to an Even-Number Page

FIG. 4(*d*) shows an example in which a bundle of duplicate copies page 2 to page 6 of the original is obtained. By depressing the "Even-Even" button, a process (7) shown in FIG. 8 is carried out.

If the printing button 35 is depressed, then a program F is carried into practice. The program F is similar to the program A except that the copy sheet feeding timing is advanced in step a'''. Thus page 6 is printed on one surface of a copy sheet, and the copy sheet having the image of page 6 on one surface thereof is ejected. Then the pages of the original are turned and the printing button 35 is depressed. As a result, the programs D+E are carried into practice, so that page 5 and page 4 are printed on opposite surfaces of a copy sheet, and the copy sheet having the images of page 5 and page 4 printed on opposite surfaces thereof is ejected. The pages of the original are turned and the final printing button 33 is depressed. As a result, the programs D+E are carried into practice, so that page 3 and page 2 on opposite surfaces of another copy sheet, and the copy sheet having the images of page 3 and page 2 thereon is ejected. At the same time, a copying termination indication is given.

Bundles of duplicate copies obtained by the aforesaid operations are shown in the lower portions of FIGS. 4(*a*), 4(*b*), 4(*c*), and 4(*d*).

The final printing button 33 is provided in order that a copying operation for a page which is not required may not be performed. When one of the two pages placed on the original placing glass plate does not need to be copied, the memory 42 stores a unit of data prohibiting the copying apparatus from performing an unnecessary copying operation. However, a final program as presently to be described can be carried into practice depending on the combination of the conditions for closing the binding side selection switch 31 and page classification selection switch 32 and the conditions for closing the final printing button 33.

Figure 5:
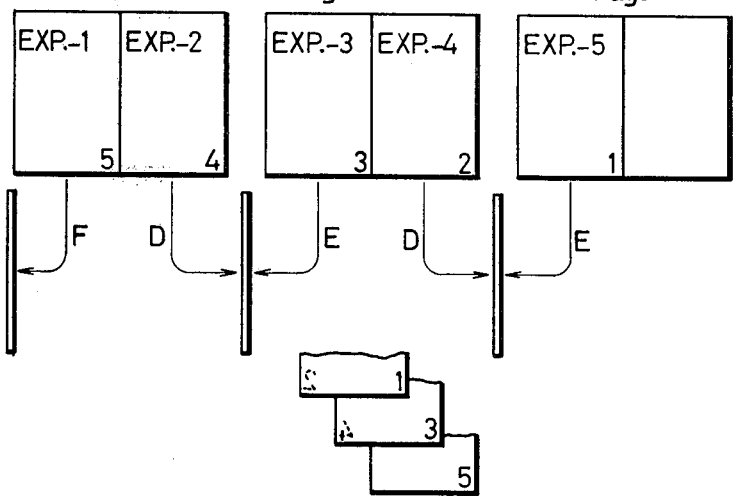
FIGS. 5(*a*) to 5(*d*) are views similar to FIGS. 4(*a*) to 4(*d*) but dealing with a book original bound on its right side.
Figure 5B:
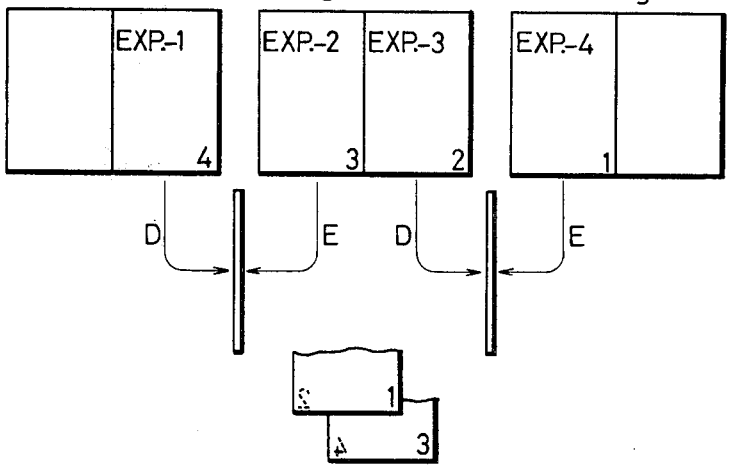
Figure 5:
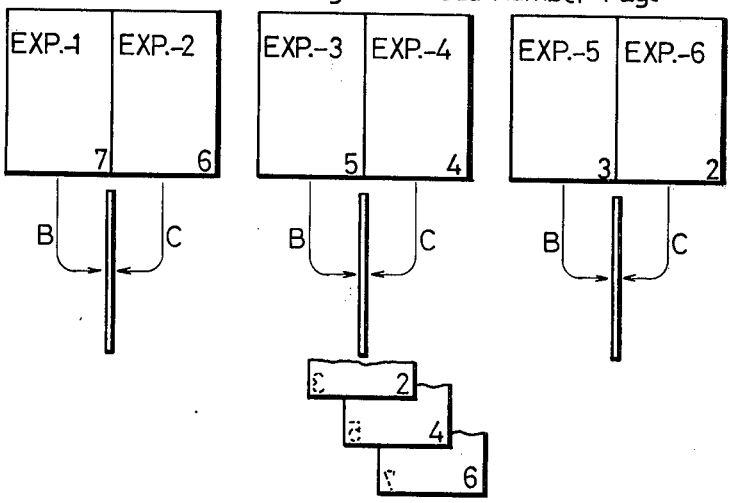
Figure 5D:
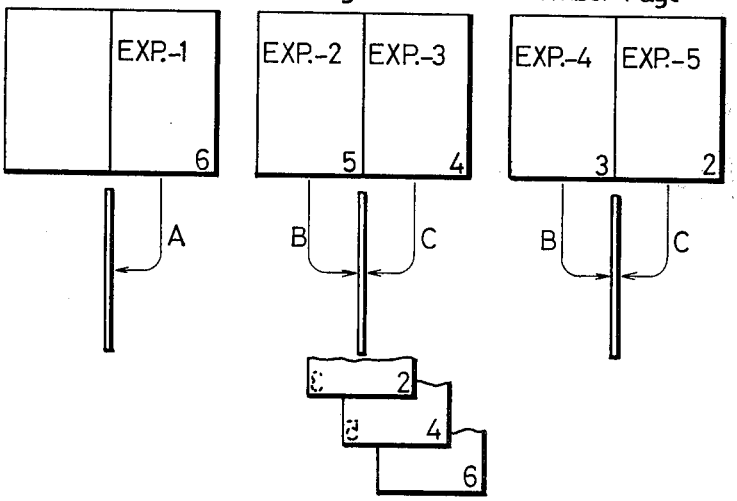

FIG. 5(*a*) to 5(*d*) show the order in which pages are printed and the arrangement of the duplicate copies obtained when originals are books bound on the right side. FIGS. 5(*a*) to 5(*d*) correspond to FIGS. 4(*a*) to 4(*d*) respectively which deals with copying of pages of books bound on the left side. The operations illustrated in FIGS. 5(*a*) to 5(*d*) are similar to those described with reference to FIGS. 4(*a*) to 4(*d*), except that the "Right-Side-Bound Book" button is depressed. However, the control programs selected ae such that the order of pages and the order in which the pages are printed in the case of a right-side-bound book are reversed to those of a left-side-bound book. Therefore, the programs selected and carried into practice in the operations shown in FIGS. 5(*a*), 5(*b*), 5(*c*) and 5(*d*) correspond to those which are selected and carried into practice in the operations shown in FIGS. 4(*d*), 4(*c*), 4(*b*) and 4(*a*) respectively. More specifically, in the operation shown in FIG. 5(*a*), the programs F, D+E, and D+E are carried out; in the operation shown in FIG. 5(*b*), the programs D+E and D+E are carried into practice; in the operation shown in FIG. 5(*c*), the programs B+C, B+C and B+C are carried into practice; and in the operation shown in FIG. 5(*d*), the programs A, B+C, and B+C are carried into practice. "Indication of Original Change", "Turning on Final Printing Button" and "Indication of termination of copying" are made at predetermined times, as is the case with the operations dealing with left-side bound books.

The operations shown in FIGS. 5(*a*) to 5(*d*) are related to the operations shown in FIGS. 4(*a*) to 4(*d*) as aforesaid, so that in concrete examples subsequently to be described, the programs are switched between the operations shown in FIGS. 4(*a*) to 4(*d*) and the operations shown in FIGS. 5(*d*) to 5(*a*) by depressing either the "Right-Side-Bound Book" and the "Left-Side-Bound Book" buttons.

The time elapsing or the distance covered by the movement of the scaner which elapses before illumination of a page of interest is started may vary depending on the size of a book used as an original. To compensate for the differences in time and distance, a copy sheet feeding timing may be altered in conjunction with a copy sheet size selection switch (not shown).

Figure 6A:
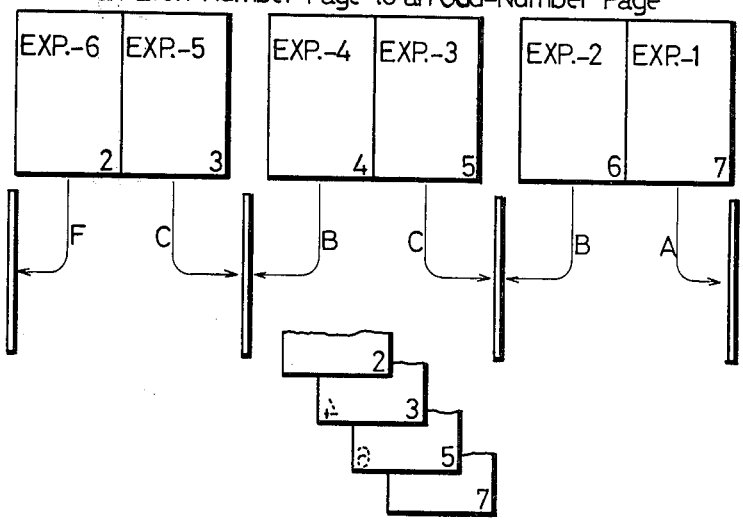
FIGS. 6(*a*) and 6(*d*) are views showing a modification of the manner in which copying is carried out as shown in FIGS. 4(*c*) and 4(*d*); manner in which copying is carried out as shown in FIGS. 5(*c*) and 5(*d*)
Figure 6B:
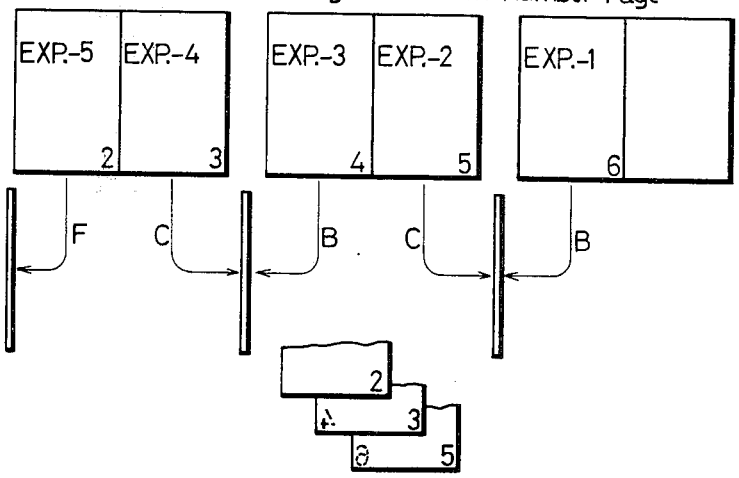
Figure 7A:
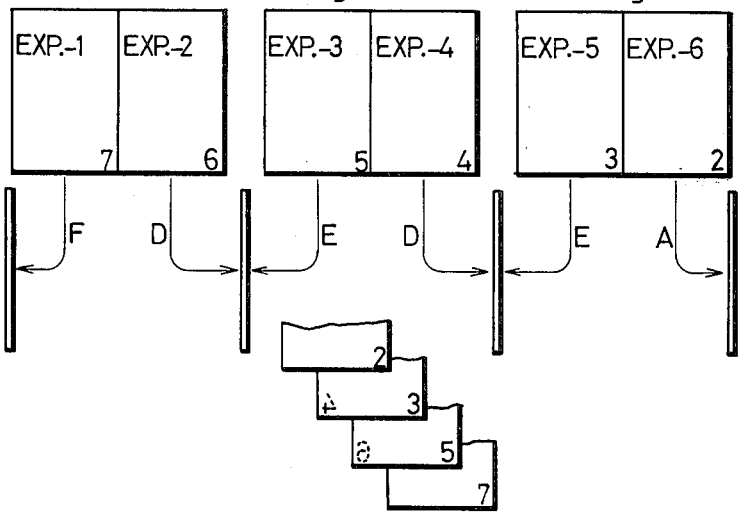
Figure 7B:
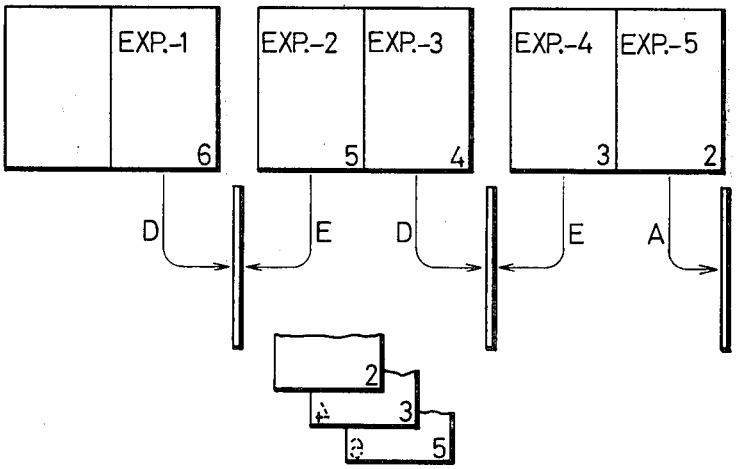
Figure 8A:
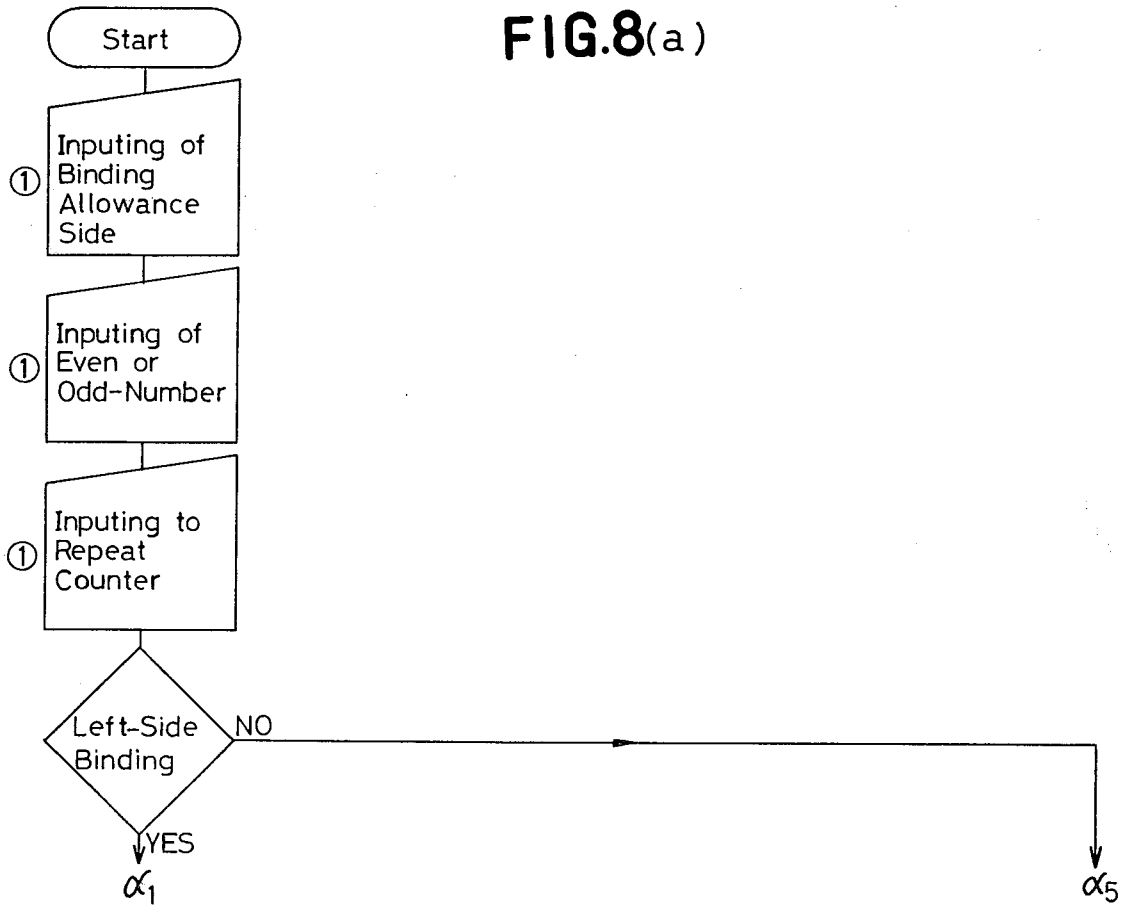
FIGS. 8(*a*) to 8(*j*) show a block chart showing the manner in which control of the operation of the copying apparatus is effected when copying is carried out as shown in FIGS. 4(*a*) to 4(*d*)
Figure 8B:
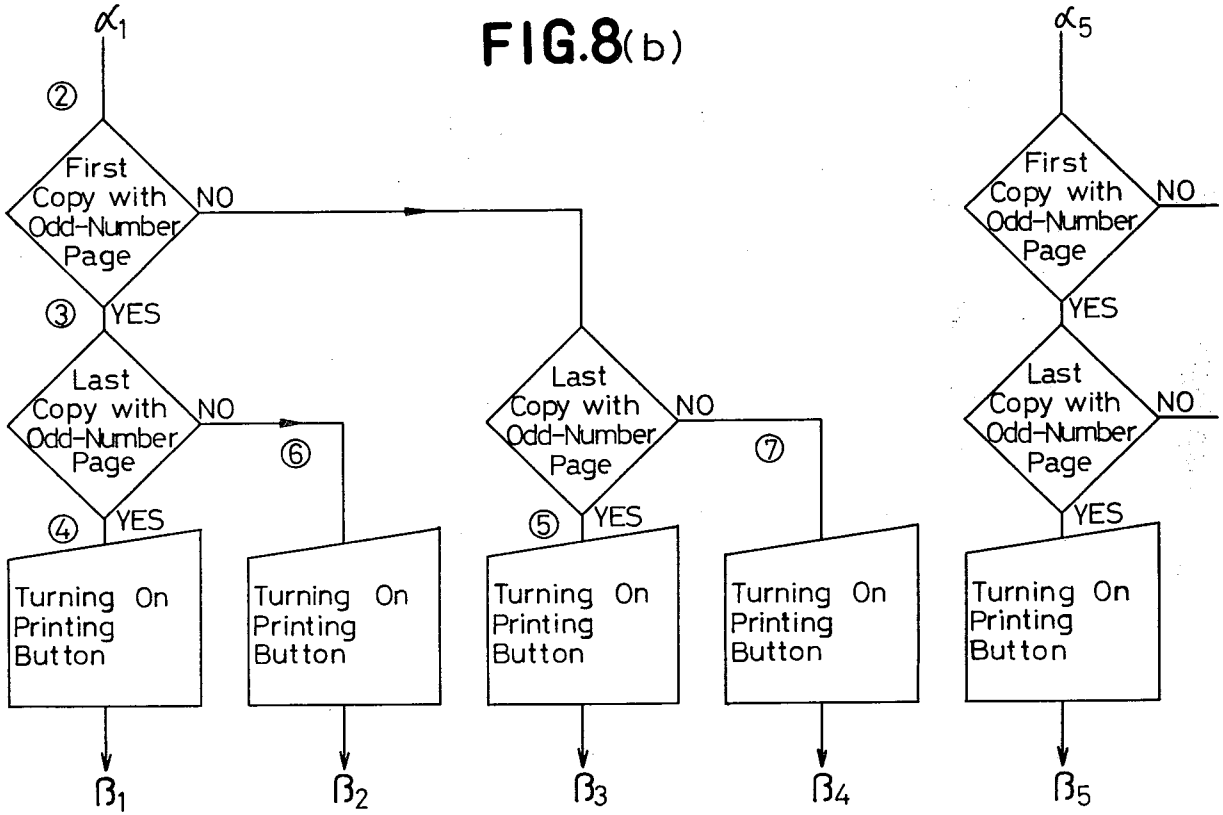
Figure 8C:
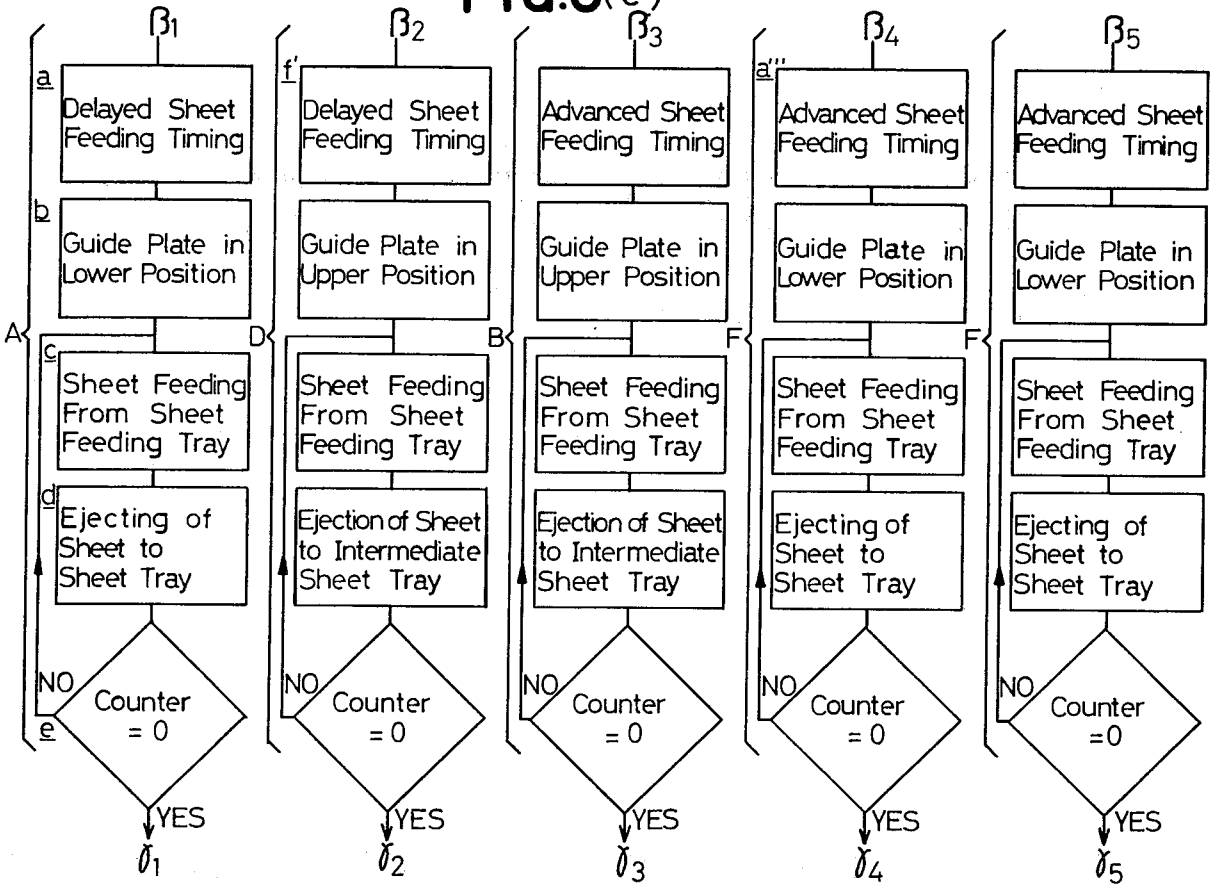
Figure 8D:
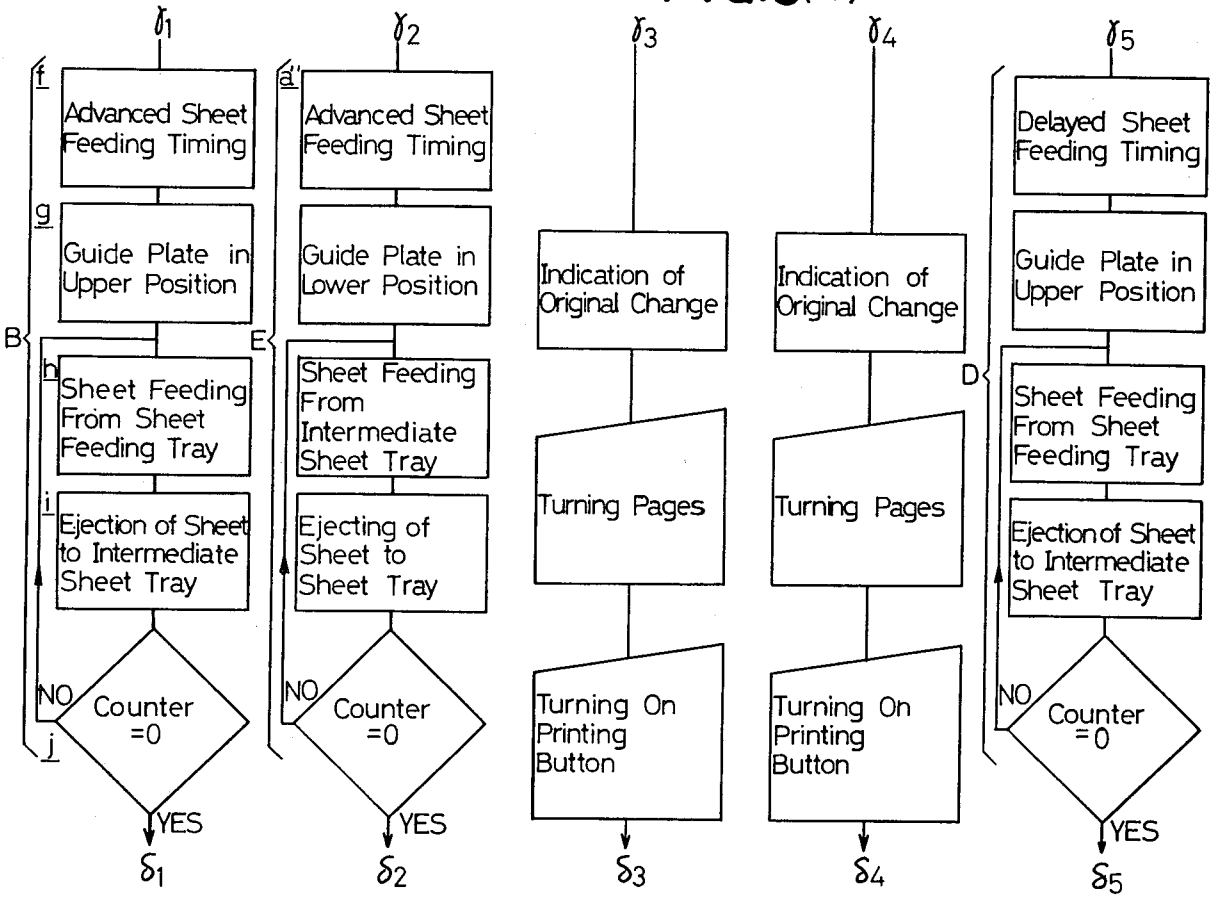
Figure 8E:
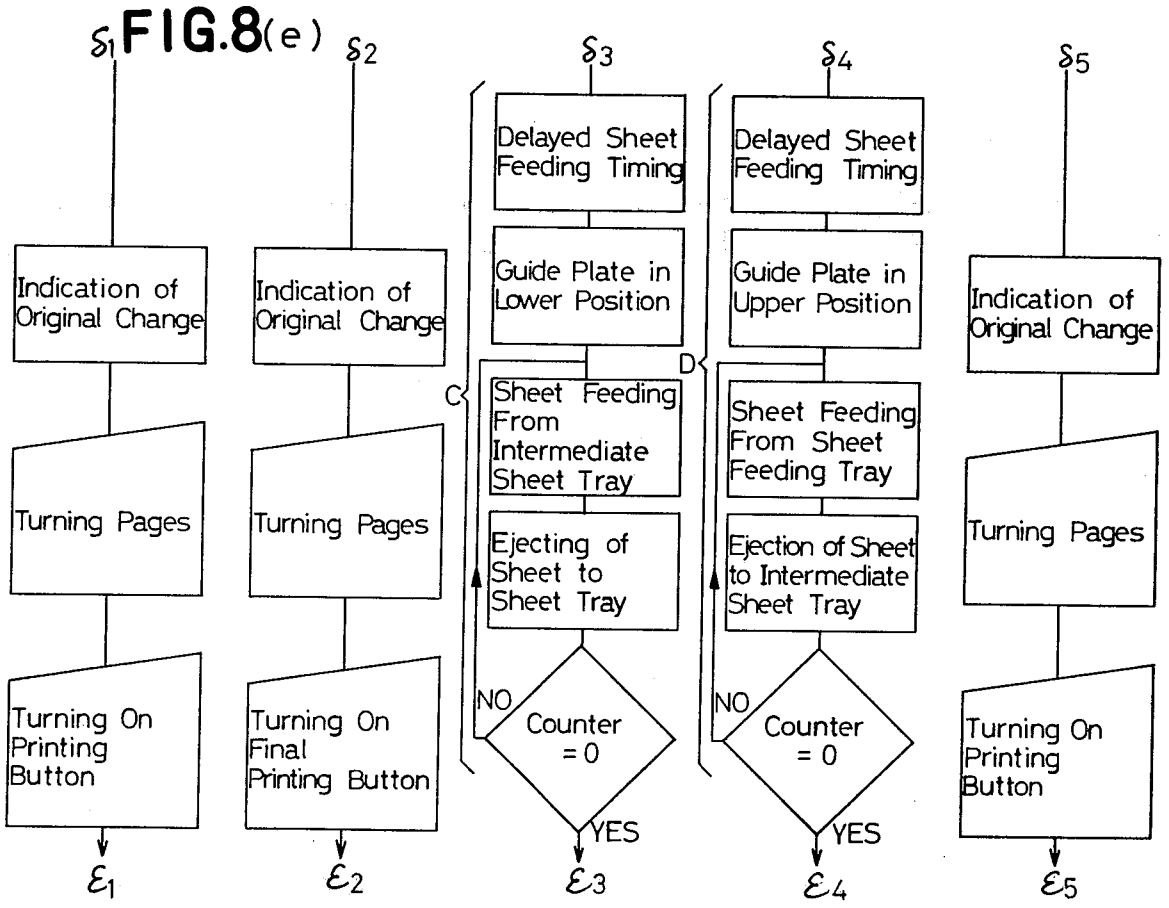
Figure 8F:
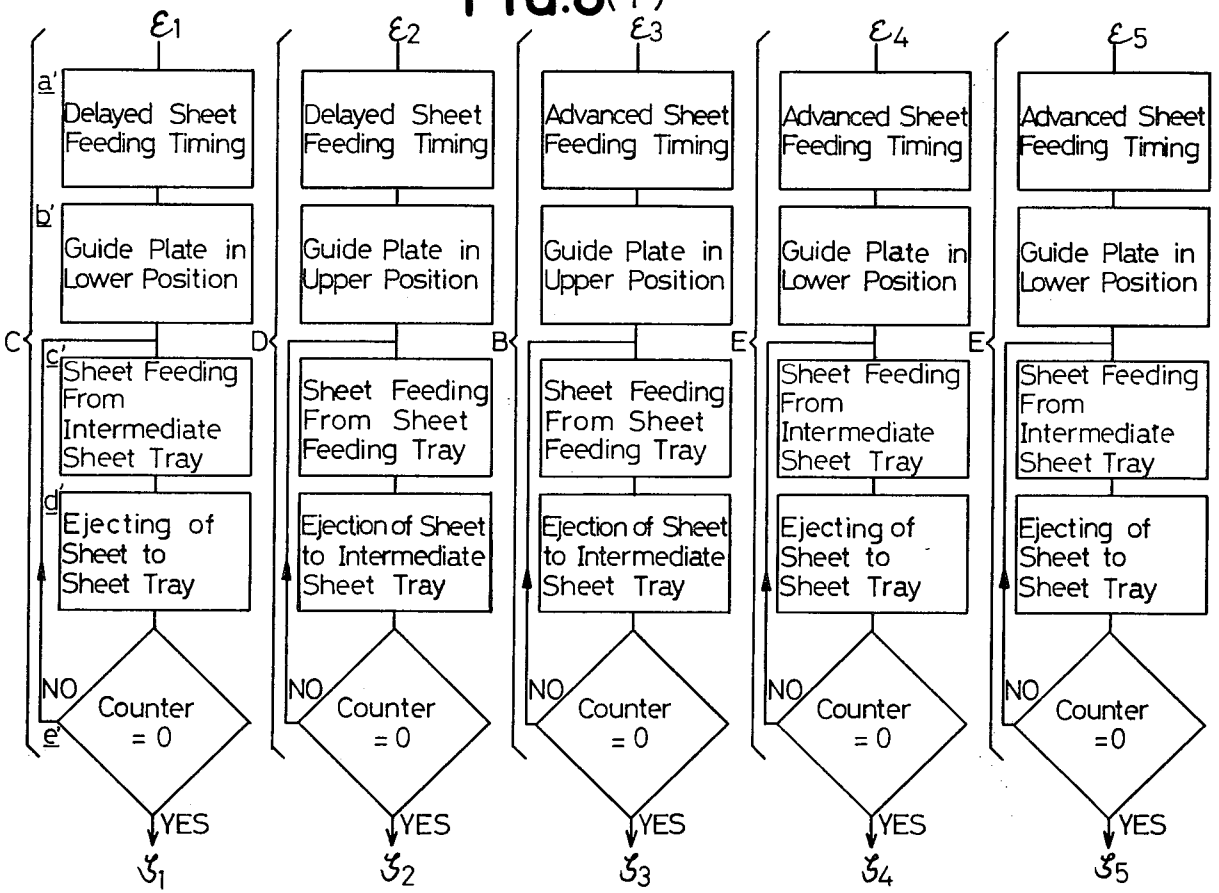
Figure 8G:
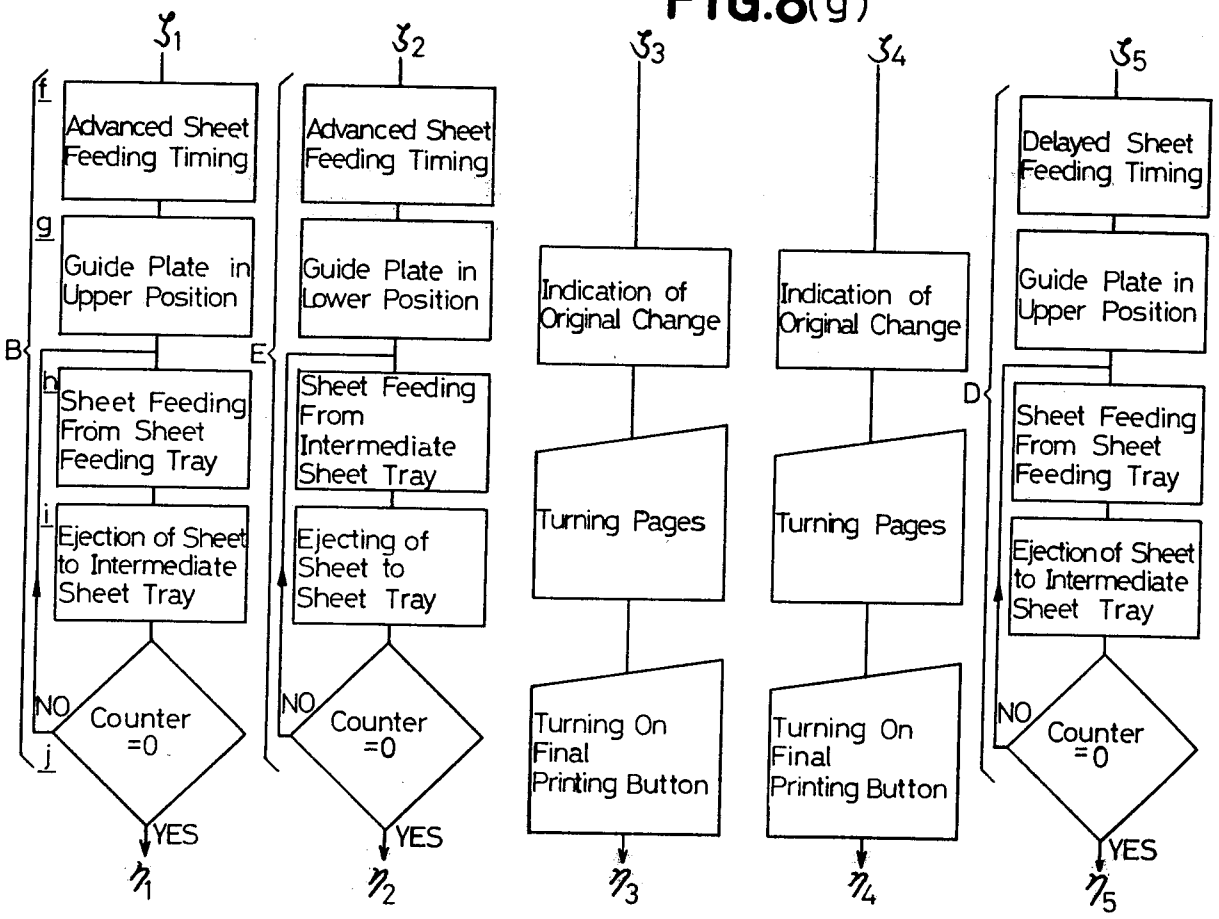
Figure 8I:
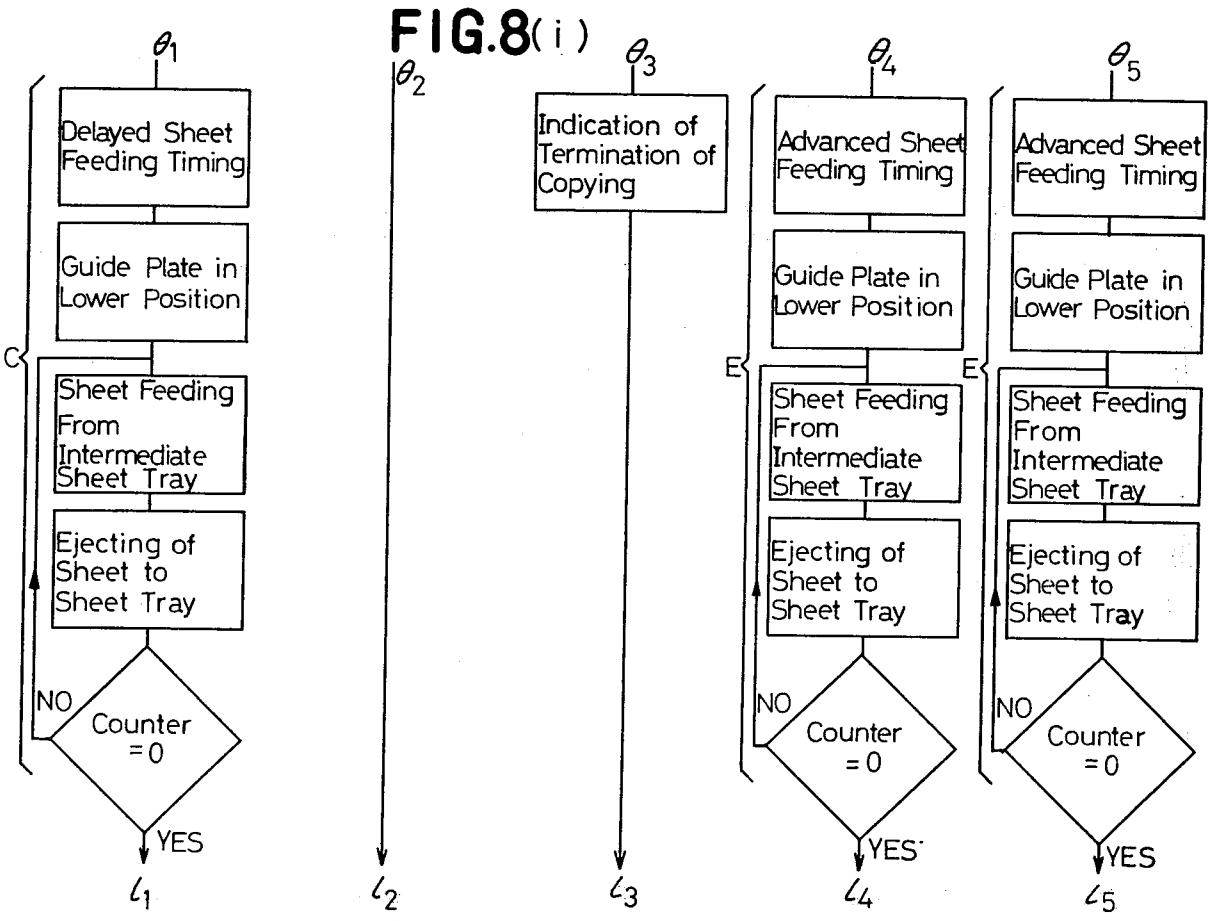
Figure 8J:
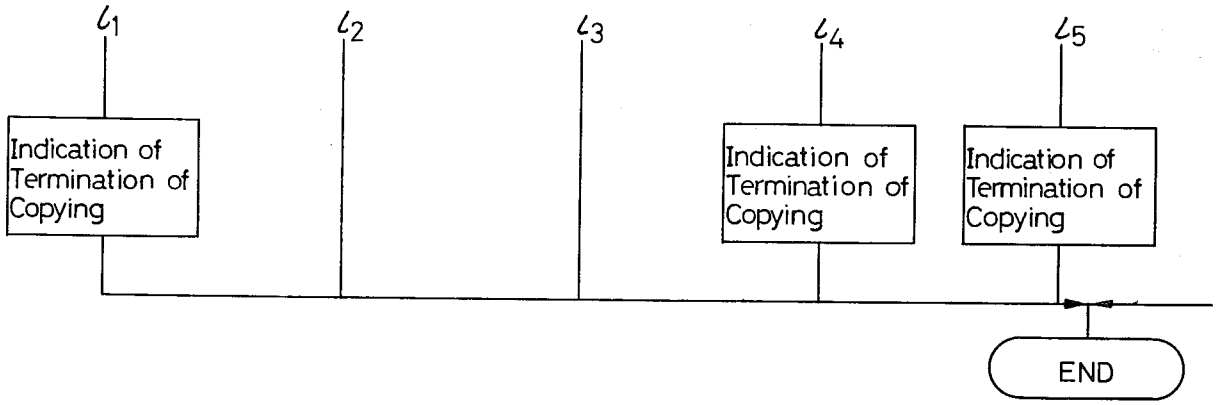

By controlling a copying apparatus as aforesaid, it is possible to obtain a bundle or bundles of duplicate copies of pages of a book arranged in the correct order, by merely opening the book at desired pages and placing the open book on the original placing glass plate of the copying apparatus in such a manner that the top of the book is remote from the operator. However, as shown in FIGS. 4(*c*) and 4(*d*) and FIGS. 5(*c*) and 5(*d*), when pages to be copied are "Odd-Even" or "Even-Odd", the adjacent two pages of a book are printed on opposite surfaces of one copy sheet, with the result that the printed images and the pages face opposite directions. Therefore, although copying two images on opposite surfaces of a copy sheet offers many advantages, this manner of copying deviates from the faithful duplication of an original and may cause some trouble. For example, if a drawing and a description thereof are carried on the adjacent pages, the drawing and the description will be printed separately on opposite surfaces of the copy sheet, causing trouble to the reader. Such disadvantage can be obviated by modifying the programs for the operations shown in FIGS. 4(*c*) and 4(*d*) into those shown in FIGS. 6(*a*) and 6(*b*) and the programs for the operations shown in FIGS. 5(*c*) and 5(*d*) into those shown in FIGS. 7(*a*) and 7(*b*). More specifically, when an original is a left-side-bound book and the pages to be copied are "Even-Odd", the programs A, B+C, B+C and F are carried into practice as shown in FIG. 6(*a*); when an original is a right-side-bound book and the pages to be copied are "Even-Odd", the programs F, D+E, D+E and A are carried into practice as shown in FIG. 7(*a*); when an original is a left-side-bound book and the pages to be copied are "Even-Even", the programs B+C, B+C and F are carried into practice as shown in FIG. 6(*b*); and when an original is a right-side-bound book and the pages to be copied are "Even-Even", the programs D+E, D+E and A are carried into practice as shown in FIG. 7(*b*). Such programs may be stored in the memory 42 in place of the programs for the operations shown in FIGS. 4(*c*) and 4(*d*) and FIGS. 5(*c*) and 5(*d*). Alternatively, two sets of programs may be selectively carried into practice.

If programming is effected as aforesaid, a bundle of duplicate copies produced will have an order and arrangement of pages exactly the same as the original, except that the last printed page is discontinuous with the previously printed page. For example, in the example shown in FIG. 6(*a*), page 2 and page 7 are each printed on one surface of a copy sheet, and pages 7 to 3 are arranged in proper order with the odd-number pages facing upwardly, with page 2 facing upwardly in spite of the page being an even-number one. Thus the pages are discontinuous between pages 2 and 3. However, this causes no trouble for practical purposes, and all the pages are considered to be arranged in proper order as a whole. A suitable inverting means, such as a sorter or collator may be used to turn over the copy sheet having the image of page 2, so that a bundle of duplicate copies can be obtained which has pages arranged in proper order like the original.

A copying apparatus may be programmed as desired. For example, programs for the copying apparatus to carry into practice may be set beforehand, or selection buttons may be increased in number to enable the operator to select any one of the programs which may be carried into practice as desired.

From the foregoing description, it will be appreciated that in the embodiment of the control method described hereinabove, it is possible to produce a bundle or bundles of duplicate copies of desired pages of a book original printed on opposite surfaces of copy sheets in such a manner that the order and arrangement of pages, the side on which the bundle is bound and the binding allowance are the same as those of the book original, by merely actuating one of the selected book-bound-side selection switches and one of the selected page classification selection switches and depressing the final printing button where necessary. If it is desired to produce a plurality of bundles, the end can be attained by manipulating the repeat dial. A book original may be successively opened at the desired pages and has only to be placed on the original placing glass plate in a normal manner or with the top of the book remote from the operator. Even if only one of the two adjacent pages is required to be copied, the operation to be performed is similar to that for producing copies of two pages. Therefore, handling of the book original is facilitated as contrasted with a conventional control method for a copying apparatus of the type described. Thus, no misoperation will occur and the time required for effecting copying can be shortened. To move a book original to left or right merely because only one of the adjacent pages is required to be copied often causes an error in operation. The obtained pages may sometimes be not in proper order, thereby making it impossible to realize advantages of copying on opposite surfaces of a copy sheet.

The aforesaid embodiment has been described with reference to a copying process by which one copy is obtained for one illumination and exposure. It is to be understood that the embodiment may have application in a multiple copy printing process in which an electrostatic latent image formed on the photosensitive drum by exposing the same to an optical image of the original placed on the original placing glass plate by a single illuminating operation is utilized for producing a plurality of copies thereof by successively developing and printing visible images on copy sheets, without erasing the latent images. If the invention is applied to a multiple copy printing process, the photosensitive drum has only to be exposed to an optical images of a page only once when a repeat operation is performed, with developing and transfer printing being automatically performed within the copying apparatus. Thus the operator can have a time to spare between the preceding exposing operation and the next following exposing operation, so that the operator can turn the pages of a book original without being bothered with other operations. Moreover, since the number of times of the exposing of the photosensitive drum is reduced, application of the control method to a multiple copy printing process offers the advantages that the service life of the copying apparatus is lengthened, power can be saved and no damage is caused to the book.

For the operating buttons shown in FIG. 3, a 10-key input means (buttons representing digits of a pushbotton telephone or a desk-top calculator), may be provided. If this is the case, by inputing the first page and the last page of the requred pages of a book by using a 10-key input means, it is possible to cause the copying apparatus to automatically select "Odd-Odd", "Odd-Even", . . ., so that the buttons 32 can be eliminated. Also, if this means is utilized to modify part of the programs, it is possible to automatically cause the copying action for the final page to be switched, thereby enabling elimination of the final printing button 33. In this case, the printing button 35 can be used for giving instructions on the performance of a final printing operations, thereby facilitating operation of the copying apparatus.

In the aforesaid embodiment, the scanner never begins its movement at the central binding portion of a book original and starts from its home position at all times. Thus the copying apparatus for carrying into practice the first embodiment of the method in conformity with the invention can have a simple construction. However, in the embodiment referred to hereinabove, a series of copying processes including illumination, exposing, developing, etc., must be performed for each of the open pages of a book original placed on the original placing glass plate, with a result that copying of a book oroginal is a timeconsuming operation. FIGS. 9 to 19 show a second embodiment of the control method and a copying apparatus adapted to carry the second embodiment into practice, which eliminate the aforesaid disadvantages of the first embodiment of the invention. In the second embodiment, the two pages of the open book original can be illuminated continuously in one direction so as to continuously perform a series of copying processes including exposing, developing, transferprinting, etc., for the two pages, so that the time required for copying a series of pages of a book original can be shortened. The second embodiment will now be described in detail.

As described with reference to FIG. 1, there are two types of books, one being a right-side-bound type and other being a left-side-bound type. FIGS. 10 to 13 show a left-side-bound book original open at desired pages and located such that the top of the book original is remote from the operator, and FIGS. 14 to 17 shows a right-side-bound book original in the same condition as the left-side-bound book original shown in FIGS. 10 to 13. As aforesaid, almost all the books are bound such that the odd-number pages of each book original are located on the same side as the front cover of the book original (See FIG. 1(*a*) and FIG. 1(*b*)) In other words, when the book is opened shown in FIGS. 10 to 13 and 14 to 17, the even-number pages of the book are located on the same side as the front cover of the book. Therefore, in the description to be made hereinafter, only such book originals as have their odd-number pages located on the same side of their front covers as shown in FIG. 1(*a*) and FIG. 1(*b*) will be dealt with.

As aforesaid, in producing duplicate copies of book originals of the aforesaid type, the following combination of pages of each book original will be thought of by the operator:

(1) A combination in which odd-number to odd-number pages are continuously copied (odd-odd);

(2) A combination in which odd-number to even number copies are continuously copied (odd-even);

(3) A combination in which even-number to odd-number copies are continuously copied (even-odd); and (4) A combination in which even-number to even-number pages are continuously copied (even-even).

These combinations can occur both in right-side-bound and left-side-bound book originals.

Figure 9:
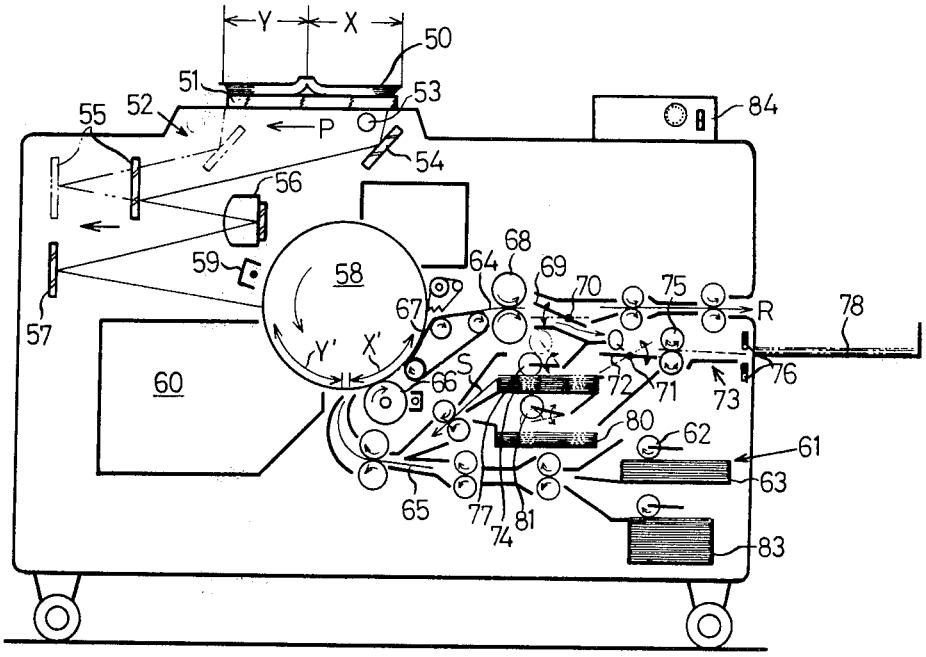
FIG. 9 is a schematic view of a copying apparatus in which a second embodiment of the control method according to the invention is adapted to be carried into practice.

The second embodiment of the invention has been developed for the purpose of enabling a book original of any type to be copied in any one of the aforementioned combinations by a simple manipulation of the copying apparatus. One example of the copying apparatus which is adapted to carry the second embodiment into practice is shown in FIG. 9.

The second embodiment of the control method in conformity with the nvention will be described by referring to the performance of a copying operation in accordance with each of the four combinations described above by means of the copying apparatus shown in FIG. 9. Description will first refer to a left-side-bound book original shown in FIG. 1(*a*).

I. LEFT-SIDE-BOUND BOOK ORIGINAL

Copying of an Original from an Odd-Number Page to an Odd-number Page (Odd-Odd)

Figures 10, 10B:
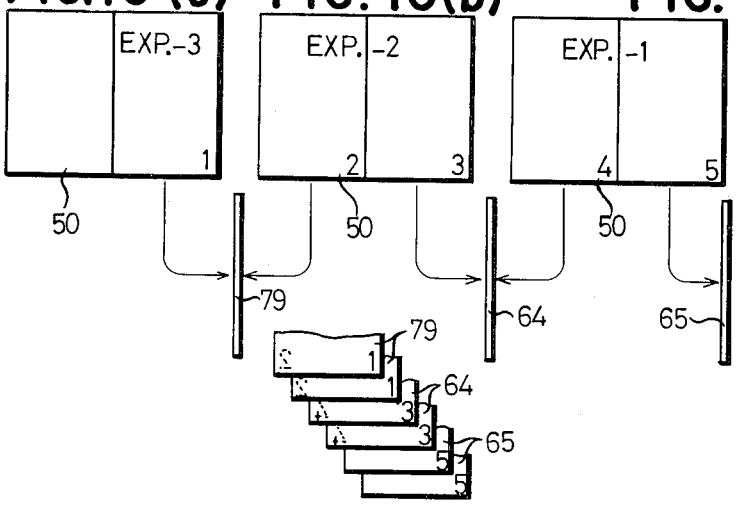
FIGS. 10 to 13 are views in explanation of the manner in which pages of a book original bound on its left side are copied by the second embodiment of the invention.

FIG. 10 shows an example in which a plurality of pages starting from page 1 (odd-number) and ending at page 5 (odd-number) of a book original 50 are copied. In FIG. 10, the numerals at the lower ends of the pages designate the numbers of pages to be copied, as is the case with the first embodiment. This applies to FIGS. 11 to 17. In this embodiment too, copying of the pages is carried out by turning the pages backwardly from pages of lager numbers to pages of smaller numbers, starting at the pages of the largest numbers. The adjacent two pages at which the book is opened are considered to form a unit. In FIG. 10, EXP. 1, EXP. 2, . . . indicate the order in which illumination is carried out for each unit of the book original. This also applies to FIGS. 11 to 17.

In this example, the book original 50 is opened first at pages 4 and 5 as shown in FIG. 10(*a*) and placed on the original placing glass plate 51 as shown in FIG. 9. The book original 50 is disposed on the plate 51 in such a manner that the spine thereof is disposed perpendicular to the direction in which the book original is scanned by an optical system as shown by an arrow P, and that page 4 of the original 50 is disposed on the right side X while page 5 is disposed on the left side Y. That is, the book original 50 is arranged such that its top is remote from the operator.

If a printing button 87 (See FIG. 18) is pressed, then a series of copying processes are performed. When it is desired to produce a plurality of copies for each page of the book original 50, a repeat dial 89 (See FIG. 18) of a repeat mechanism which is known is set at a desired number.

Depression of the printing button 87 causes a light source 53 and a first mirror 54 of an exposing optical system 52 to move leftwardly P from a right-side position (home position) shown in solid lines to a left-side position shown in dash-and-dot lines, so that pages 4 and 5 of the original 51 are continuously scanned and illuminated by a light flux emanating from the light source 53. The light reflected by the original 51 is thrown, through a movable second mirror 55, an in-mirror lens 56 and a fixed mirror 57, onto the surface of a photosensitive drum 58 to expose the surface to optical images of pages 4 and 5. Prior to exposure, the photosensitive drum 58, which rotates counterclockwise in FIG. 9, is charged by a charger 59, so that the charged surface of the photosensitive drum 58 is exposed to the optical images of pages 4 and 5 of the original 50. More specifically, an electrostatic latent image of page 4 located on the right side X of the plate 51 is first formed, and then an electrostatic latent image of page 5 located on the left side Y thereof is formed continuously. The two latent images are developed into visible images at a developing station 60. The images formed on the surface of the photosensitive drum are represented by a first portion X and a second portion Y′ respectively on the surface of the photosensitive drum 58. Stated differently, in this example, an image of page 4 of the book original 50 is formed on the portion X′, and an image of page 5 thereof is formed on the portion Y′.

Meanwhile a copy sheet feeding roller 62 of a main copy sheet feeding device 61 is rotated in timed relation to the rotation of the photosensitive drum 58, so that two copy sheets 64 and 65 are fed successively from a stack of copy sheets piled on a copy sheet feeding tray 63. The copy sheets 64 and 65 are delivered by feed rollers to the photosensitive drum 58. The first copy sheet 64 is brought into contact with the image X′ of page 4, which is printed on the first copy sheet 64 by means of a transfer-printing roller 66. Likewise, the image Y′ of page 5 is printed on the second cop sheet 65. Thus the first unit of the book original 50 consisting of the pages 4 and 5 is continuously illuminated to form images thereof on the surface of the photosensitive drum 58, and the images of pages 4 and 5 are printed on separate copy sheets. After being printed, the two copy sheets 64 and 65 are separated from the photosensitive drum 58 by separating means 67, and the printed images are fixed on the respective copy sheets by fixing means 68.

A first switching means in the form of a switching guide plate 69 is mounted posterior to the fixing means as seen in the direction of movement of copy sheets. The first switching guide plate 69 is movable between a solid line position and a dash-and-dot line position about a pivot 70. When the guide plate 69 is located in its solid line position, a copy sheet is guided in the direction of a return path indicated by an arrow Q; when it is in its dash-and-dot line position, a copy sheet is guided in the direction of a ejecting path indicated by an arrow R. A second switching means in the form of a switching guide plate 72 is arranged in a suitable position in the return path for movement between its solid line position and its dash-and-dot line position about a pivot 71. A switchback portion 73 is arranged in proximity to the second switching guide plate 72, and a first intermediate tray 74 of a first intermediate copy sheet feeding means is located opposite the switchback portion 73 with respect to the second switching guide plate 72.

When the first copy sheet 64 introduced into the fixing means 68 is released therefrom, the switching guide plates 69 and 73 are in their solid line positions. Thus the first copy sheet 64 is guided to move in the direction of the return path Q and then delivered to the switchback portion 73 by rotating of a pair of two-direction rotation rollers 75. Detecting means 76 detects the feeding of the copy sheet 64 to the switchback portion 73 and issues a signal which causes the rollers 75 to reverse their direction of movement, thereby forwarding the first copy sheet 64 to the first intermediate tray 74. At this time, a copy sheet feeding roller 77 of the first intermediate copy sheet feeding means is moved away to a dash-and-dot line position, so that the movement of the first copy sheet 64 into the first intermediate tray 74 is not prevented. The first copy sheet 64 introduced into the first intermediate tray 74 is located such that the surface thereof which bears the image of page 4 faces upwardly.

Simultaneously as the first copy sheet 64 is released from the fixing means 68, the first switching guide plate 69 is quickly moved to its dash-and-dot line position. Thus the second copy sheet 65 which is released from the fixing means 68 following the first copy sheet 64 is guided in the direction of the ejecting path R, so that the copy sheet 65 is ejected onto a copy sheet ejecting tray 78 by ejecting rollers. The second copy sheet 65 is ejected and placed on the tray 78 in such a manner that the surface thereof on which the image of page 5 is printed faces upwardly.

The duplicate copies obtained by the aforesaid operation are shown in FIG. 10(*a*). It will be seen that the image of page 5 of the book original 50 is printed on one surface of the second copy sheet 65, and the image of page 4 is printed on one surface (the right surface in FIG. 10) of the first copy sheet 64.

By the aforesaid operation, one copy each of the duplicates of pages 4 and 5 is produced. When a repeat performance is carried out for producing a plurality of duplicates for each page of the book original, the aforesaid operation is repeated the number of times which correspond to the number of duplicates desired. When this is the case, a plurality of second copy sheets 65 having the images of page 5 printed thereon and a plurality of first copy sheets 64 having the images of page 4 printed thereon are stacked on the copy sheet ejecting tray 78 and the first intermediate tray 74 respectively in a number which corresponds to the number of repeat operations selected beforehand.

In the aforesaid description, a series of copying processes including illumination, exposing, developing, transfer-printing, etc., have been described as being repeated each time a repeat operation is performed. However, it is to be understood that a multiple copy printing process may be advantageously used without repeating all the copying processes for each repeat performance. When a multiple copy printing process is carried out, illumination of the original and exposing of the photosensitive drum to optical images of pages 4 and 5 are eliminated for the second and following copy sheets for pages 4 and 5, and the electrostatic latent images formed in the initial illumination and exposing is not erased but used for producing visible images at the developing station 60. The developed images are printed on the second and following copy sheets for printing the images of pages 4 and 5. Upon completion of a repeat performance, the photosensitive drum 58 has latent images erased and is cleaned.

Upon completion of the aforementioned processes, the pages of the book original 50 are turned so as to open the same at pages 2 and 3 as shown in FIG. 10(*b*). The book original 50 opened in this way is turned over and placed on the original placing glass plate 51 so that page 2 may be located on the right side X of the plate 51 and page 3 may be located on the left side Y thereof. Thus the operator has only to turn the pages and need not turn the book original upside down or perform any other operation. If an indication mechanism is actuated when processing of pages 4 and 5 is completed to light an indicating lamp (see FIG. 18), the handling of the book original 50 by the operator can be facilitated. Also, if a repeat performance is carried out by adopting a multiple copy printing process as aforementioned, illumination of the pages of the book original has only to be performed once for exposing the photosensitive drum 58, and developing, transfer-printing and other processes can be performed automatically within the copying apparatus. This affords the operator with spare time, so that the operator can turn the pages without being bothered with other manipulation of the apparatus.

Upon pressing the printing button again, pages 2 and 3 are scanned by the illumination optical system and the photosensitive drum 58 is exposed to optical images of these two pages, as is the case with pages 4 and 5 described above. Thus, a latent image of page 2 is formed on the first portion X′ and a latent image of page 3 is formed on the second portion Y′ of the photosensitive drum 58. For printing the images of pages 2 and 3, a third copy sheet 79 alone [See FIG. 10(*c*)] is fed from the stack of copy sheets on the main copy sheet feeding device 61. A developed image of the latent image of page 2 on the first portion X′ of the drum 58 is printed on the third copy sheet 79. If the third copy sheet 79 is fed from the device 61, then the copy sheet feeding roller 77 of the first intermediate tray 74 is brought into contact with the upper surface of the first copy sheet 64 and rotates after a suitable time lag behind the feeding of the third copy sheet 79, so that the first copy sheet 64 is fed from the first intermediate tray 74. Thus the first copy sheet 64 is moved in the direction of the arrow S toward the photosensitive drum 58 following the third copy sheet 79, so that the image of page 3 on the second portion Y′ of the drum 58 is printed on the blank surface of the first copy sheet 64 which is opposite the surface on which the image of page 4 is already printed as described hereinabove.

When the third copy sheet 79 on which an image of page 2 is printed is released from the fixing means 68, the two switching guide plates 69 and 72 are in their solid line positions, so that the third copy sheet 79 is forwarded in the direction of the return path Q and reaches the switchback portion 73. When the detecting means 76 detects the arrival of the third copy sheet 79 to the switchback portion 73, the two-direction rollers 75 rotates in the opposite direction and at the same time the second switching guide plate 72 is moved to its dash-and-dot line position. Thus the third copy sheet 79 is introduced into a second intermediate tray 80 of a second intermediate copy sheet feeding device located beneath the first intermediate tray 74. At this time, a copy sheet feeding roller 81 of the second intermediate tray 80 is withdrawn upwardly, and the third copy sheet is disposed with the image of page 2 facing upwardly. On the other hand, the first copy sheet 64 released from the fixing means 68 immediately following the third copy sheet 79 is forwarded in the direction of the copy sheet ejecting path R and ejected onto the copy sheet ejecting tray 78, because the first switching guide plate 69 is moved to its dash-and-dot line position.

The first copy sheet 64 is ejected onto the tray 78 and placed on the tray 78 in such a manner that the image of page 3 faces upwardly.

When a repeat performance is carried out, the aforesaid processes are repeated (with no illuminating and exposing processes being performed if a multiple copy printing process is adapted). Thus all the first copy sheets 64 are ejected from the first intermediate tray 74 onto the copy sheet ejecting tray 78, and a desired number of third copy sheets 79 are piled in a stack on the second intermediate tray 80. The duplicate copies obtained in this way are clearly shown in FIG. 10. As can be understood from the foregoing description, the second intermediate copy sheet feeding device is provided for the purpose of avoiding confusion which would otherwise occur, in carrying out a repeat performance, in the single intermediate tray on which the first copy sheets 64 and the third copy sheets 79 get entangled, making it impossible to effect copying of images of pages as planned. Stated differently, copy sheets are alternately piled in a stack on the two intermediate trays, and confusion involving entanglement with one another of copy sheets formed thereon with images of different pages can be avoided. This is true of all the copying conditions.

Then a final copying action is performed which is copying of the image of page 1 in this example. The pages of the book original 50 are turned, and the book original 50 is opened at a flyleaf (referred to as page 0 for conveniences sake) and page 1. Then the opened book original 50 is turned over and placed on the original placing glass plate 51 in such a manner that page 0 is located on the right side X of the plate 51 and page 51 and page 1 is located on the left side Y thereof. Thus all that is required of the operator to perform is to turn the pages of the book original 50 and place the same on the plate 51. If copying is started, no latent image is formed on the first portion X′ and a latent image of page 1 is formed on the second portion Y′ of the photosensitive drum 58. In this case, although the light source 53 moves continuously in the direction of the arrow P from page 0 to page 1 of the book original, it is preferable that no copying processes, including illumination, exposure, developing, etc., are not performed with regard to page 0. The end can be attained by providing the final printing button which is subsequently to be described in detail with reference to FIGS. 18 and 19. Meanwhile the third copy sheet 79 standing by on the second intermediate tray 80 is fed therefrom by timing the feeding in such a manner that it is brought into index with the second portion Y′ (on which an image of page 1 is formed) of the photosensitive drum 58. After the image of page 1 is printed thereon, the third copy sheet 79 is passed through the fixing means 68 and forwarded in the direction of the copy sheet ejecting path R to be ejected onto the copy sheet ejecting tray 78. When a repeat performance is carried out, the aforementioned action is naturally repeated as required.

As described hereinabove, the images of the desired pages are printed on the first to third copy sheets 64, 65 and 79 by performing the aforementioned processes, and the copy sheets are piled in a stack on the copy sheet ejecting tray 78 in such a manner that the copy sheet 65 on which the image of page 5 is formed is located at the bottom of the stack. Thus, if the copy sheets are bound into a bundle, it is possible to produce a bundle of duplicate copies of the desired pages of the book original 50 which have the same order and arrangement of pages as the book original 50. An example of the copy sheets having the images of the desired pages printed thereon by performing a repeat performance is shown in a lower portion of FIG. 10. The example shown is one in which a repeat performance is carried out twice. By classifying the printed copy sheets by means of a known collator or a sorter (not shown), it is possible to obtain two bundles of duplicate copies of the desired pages of the book original 50 having the same order and arrangement of pages as the book original 50. When it is desired to copy a larger number of pages than those whose in FIG. 10, for example nines pages from page 1 to page 9, the end can be attained by performing the same copying processes as described hereinabove with regard to the first page and final pages and by repeating the same copying processes as described with reference to pages 2 and 3 hereinabove for the additional pages.

Copying of an Original from an Odd-Number Page to an Even-Number Page (Odd-Even)

Figures 11A, 11B, 11C:
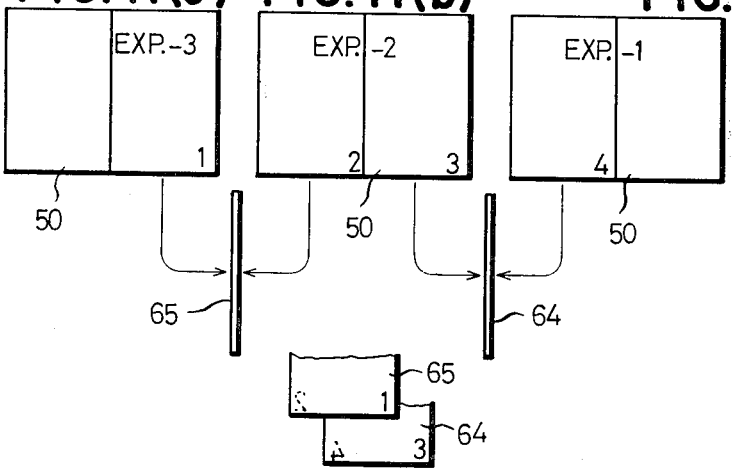

FIG. 11 shows an example in which page 1 to page 4 of the book original 50 are copied. As indicated by EXP. 1, EXP. 2 and EXP. 3 in the figure, copying is carried out from a unit of pages of larger numbers to a unit of pages of smaller numbers in this example too. The book original 50 is set on the glass table 51 in such a manner that the page of a smaller number of each unit is placed on the right side X of the original placing glass plate 51 and the page of a larger number thereof is placed on the left side Y thereof. This example is similar, in copying processes to be carried out, to the example of copying odd-odd pages except that in this example the switching guide plates 69 and 72 and copy sheet feeding timing are controlled such that images of pages will be printed on opposite surfaces of a first copy sheet 64 and a second copy sheet 65 respectively as shown in FIG. 11. More specifically, the book original 50 is first opened at pages 4 and 5 (page 5 not designated in FIG. 11 need not be copied), and pages 4 and 5 are continuously scanned by a light flux emanating from the light source 53. Conveniently a suitable control means is used so that no illumination exposing and developing processes will not be performed with regard to page 5. Thus an image of page 4 is formed on the first portion X′ of the photosensitive drum 58. Meanwhile the first copy sheet 64 (FIG. 11) is fed from the main copy sheet feeding device 61, and the image of copy 4 is printed by transfer-printing on one surface of the first copy sheet 64. The printed first copy sheet 64 is delivered to the first intermediate tray 74. Thereafter the same copying processes as performed with regard to pages 3, 2 and 1 in the example of odd-odd copying described previously with reference to FIG. 10 are performed. That is, except for the copying process performed with regard to page 5, copying processes for all the pages of the odd-even combination shown in FIG. 11 are identical with the copying processes for the pages of the odd-odd combination shown in FIG. 10. A bundle of duplicate copies obtained in the example shown in FIG. 11 has as shown in a lower portion of the figure, the same order and arrangement of pages as the book original 50. The same is rue of a plurality of bundles of duplicate copies obtained by carrying out a repeat performance (See the lower portion of FIG. 10, too).

Copying of an Original from an Even-Number Page to an Odd-Number Page (Even-Odd)

Figures 12A, 12B, 12C:
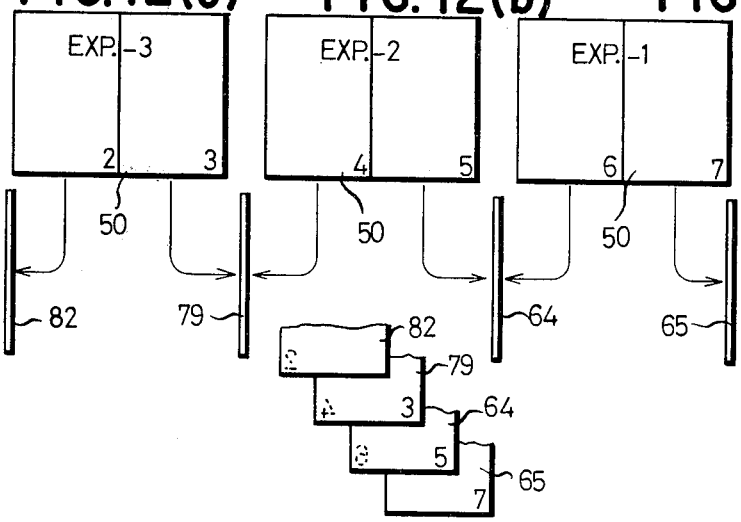

FIG. 12 shows an example in which an even-odd combination of pages are copied. In this example, the copying processes performed are identical with those performed for an odd-odd combination of pages shown in FIG. 10, except that a copying process for page 2 in FIG. 12 is additionally performed with regard to a fourth copy sheet 82. More specifically, when pages 2 and 3 are illuminated in performing a copying process for the final unit of pages 2 and 3, an image of page 2 is formed on the first portion X' of the photosensitive drum 58 and an image of page 3 is formed on the second portion Y' thereof. The fourth copy sheet 82 is fed from the main copy sheet feeding device 61, prior to the feeding of the third copy sheet 79 from the second intermediate tray 80, so that the fourth copy sheet 82 is delivered to the drum 58 in advance of the third copy sheet 79. In this case, if the printed fourth copy sheet 82 is ejected immediately, the fourth copy sheet 82 will be ejected, with the surface having the image of page 2 facing upwardly, in advance of the third copy sheet 79 which has the images of pages 3 and 4 printed on opposite surfaces thereof, thereby causing an error in the order of pages of a bundle of duplicate copies obtained. Therefore, the fourth copy sheet 82 is preferably introduced temporarily into the first intermediate 74 tray after an image of page 2 is printed thereon, and released from the intermediate tray again to be ejected from the apparatus. If this step is taken, the fourth copy sheet 82 having the image of page 2 will be ejected after the third copy sheet 79 having the images of pages 3 and 4 are ejected, so that the duplicate copies produced will be in the correct order of pages. When the fourth copy sheet 82 is fed again from the first intermediate tray 74, preferably the transfer-printing roller 66 is spaced apart from the surface of the drum 58 to prevent the contact of the copy sheet with the surface of the drum or the imparting of the transfer-printing potential to the roller 66 is prevented to avoid the depositing of the toner on the copy sheet. Alternatively, no developing operation may be performed on the drum after printing of the image of page 3 by transfer-printing is finished. A bundle of duplicate copies produced by the aforesaid operation is shown in the lower portion of page 12.

Copying of an Original from an Even-Number Page to an Even-Number Page (Even-Even)

Figures 13A, 13B, 13C:
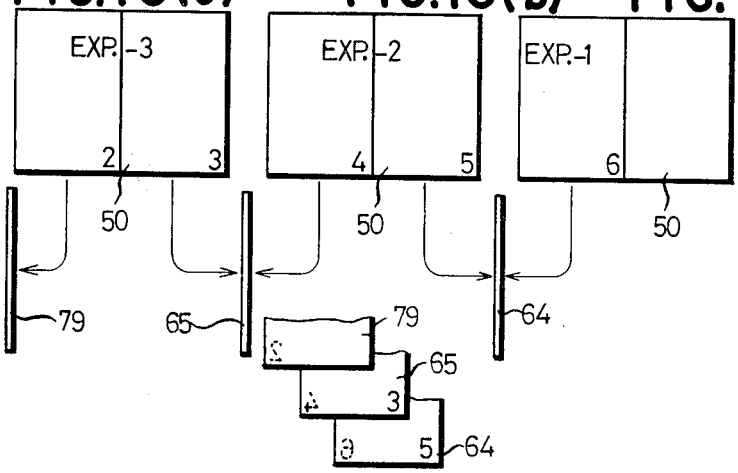
Figures 14A, 14B, 14C:
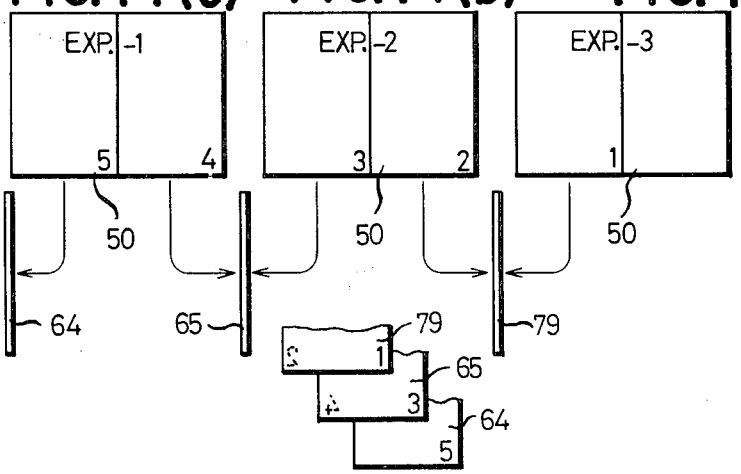
FIGS. 14 to 17 are view similar to FIGS. 10 to 13 but dealing with a book original bound on its right side.

FIG. 13 shows an example in which an even-even combination of pages are copied. As can be seen in FIG. 13, duplicate copies of this combination of pages can be produced if copying processes identical with those for the even-odd combination of pages shown in FIG. 12 are performed, except for the fact that no copying process for page 7 in the copying process is shown in FIG. 12 is performed. A copying process for page 6 which is illuminated first is identical with a copying process performed for page 4 of an odd-even combination of pages shown in FIG. 11. A bundle of duplicate copies produced in this example is shown in a lower portion of FIG. 13.

FIGS. 14 to 17 show copying processes which are performed with regard to a right-side-bound book original. The principles of a copying operation to be performed with regard to a right-side-bound book original are identical with those for a left-side-bound book original. More specifically, a right-side-bound book original is opened and opened pages are placed on the original placing glass plate 51 with the top of the book original being remote from the operator, and units of pages are copied by starting at a unit of pages of larger numbers and ending at a unit of pages of smaller numbers as indicated by EXP. 1, EXP. 2 . . ., as is the case with a left-side-bound book original. The only difference is that, if a right-side-bound original is handled in this way, a page of an odd number (page 3 shown in FIG. 14(b), for example) is located on the right side X of the plate 51 and a page of an even number (page 2 shown in FIG. 14(*b*), for example) is located on the left side Y of the plate 51. Therefore, the order in which the pages of each unit of the right-side-bound book original are illuminated by scanning with a light flux differs from the order in which illumination of pages of each unit of the left-side-bound book original is carried out. Therefore, it is necessary that control of the switching guide plates 69, 72, control of timing of withdrawing of the copy sheet feed rollers 77, 81 etc. be effected in accordance with a pattern of illumination of pages which suits the right-side-bound book originals.

If the description of copying of left-side-bound book originals set forth hereinabove with reference to FIGS. 14 to 17 is taken into consideration, it will be evident that the aforesaid changes in effecting control are necessary. Therefore, these changes in control will be outlined hereinafter.

II. RIGHT-SIDE-BOUND BOOK ORIGINAL

Copying of an Original from an Odd-Number Page to an Odd-Number Page (Odd-Odd)

FIG. 14 shows an example in which a plurality of pages starting at an odd-number page (page 1) and ending at an odd-number page (page 5) are copied. In this case, the book original 50 is placed on the plate 51 in such a manner that page 5 is located on the right side X of the plate 51 and page 4 is located on the left side Y thereof [See FIG. 14(*a*)]. An image of page 5 is formed on the first portion X' of the drum 58 and an image of page 4 is formed on the second portion Y' thereof, by following the copying processes described above. The image on the first portion X' (page 5) is printed by transfer-printing on the first copy sheet 64 fed from the feed tray 63 of the main copy sheet feeding device 61, and the printed copy sheet 64 is directly ejected onto the copy sheet ejecting tray 78 in such a manner that the copy sheet 64 is disposed on the tray 78 with the image of page 5 facing upwardly. Meanwhile the image on the second portion Y' is printed, by transfer-printing, on the second copy sheet 65 fed from the feed tray 63 immediately following the first copy sheet 64, and the printed copy sheet 65 is introduced into the first intermediate tray 74 where the copy sheet 65 is disposed with the surface having the image of page 4 facing upwardly.

Then the pages of the book original 50 are turned [See FIG. 14(*b*)], and the book original 50 is placed on the plate 51 in such a manner that a unit of pages 2 and 3 faces the plate 51 with page 3 being located on the right side X of the plate 51 and page 2 being located on the left side Y thereof, so that an image of page 3 is formed on the first portion X' of the photosensitive drum 58 and an image of page 2 is formed on the second portion Y' thereof. The second copy sheet 65 on the first itermediate tray 74 is delivered to the drum 58, so as to print on the other surface of the copy sheet 65 the image of page 3 on the first portion X'. The printed copy sheet 65 is delivered to the copy sheet ejecting tray 78 and placed thereon in such a manner that the image of page 3 faces upwardly. The third copy sheet 79 which is fed from the feed tray 63 following the feeding of the second copy sheet 65 from the first intermediate tray 74 is printed with the image of page 2 on the second portion Y' of the drum 58. The printed copy sheet 79 is delivered, by means of the switching guide plates 69, 72, to the second intermediate tray 80 and placed thereon.

The pages of the book original 50 are further turned [See Page 14(*c*)9, and the book original 50 is placed on the plate 51 in such a manner that page 1 is located on the right side X and page 0 (flyleaf) is located on the left side Y of the plate 51. An image of page 1 is formed on the first portion X' of the drum 58, and no latent image is formed on the second portion Y'. The image of page 1 on the first portion X' is printed, by transfer-printing, on the other surface of the second copy sheet 79 delivered from the second intermediate tray 80 to the drum 58, and the printed copy sheet 79 is ejected onto the copy sheet ejecting tray 78 and placed thereon with the image of page 1 facing upwardly and the image of page 2 facing downwardly.

In this way, a bundle of duplicate copies as shown in a lower portion of FIG. 14, which has the same order and arrangement of pages as the book original, is stacked on the ejecting tray 78.

Copying of an Original frm an Odd-Number Page to an Even-Number Page (Odd-Even)

Figures 15A, 15B, 15C:
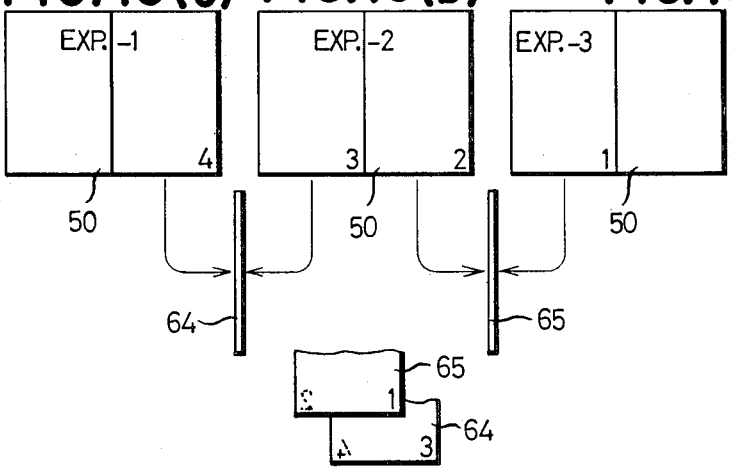

FIG. 15 shows an example in which a plurality of pages starting at an odd-number page (page 1) and ending at an even-number page (page 4) are copied. In this case, the book original 50 is placed on the original placing glass plate 51 in such a manner that page 5 which need not be copied (not shown in FIG. 15) is located on the right side X of the plate 51 and page 4 is located on the left side Y thereof. Then the pages are illuminated so as to form a latent image of page 4 on the second portion Y' of the drum 58, with no image being formed on the first portion X' thereof an image may be formed on the first portion X' but not printed on a copy sheet). The image of page 4 on the second portion Y' is printed, by transfer-printing, on the first copy sheet 64 fed from the copy sheet feeding tray 63 to the drum 58. Since no image on the first portion X' is printed, the timing of feeding the first copy sheet 64 is delayed than normal, so that the sheet 64 will be registered with the image on the second portion Y'. The first copy sheet 64 is separated from the drum 58 after the image of page 4 is printed thereon is delivered to the first intermediate tray 74 and placed thereon.

The pages of the book original 50 are turned, so that page 3 is located on the right side X of the original placing glass plate 51 and page 2 is located on the left side Y thereof. By performing the printing processes, an image of page 3 is formed on the first portion X' of the drum 58 and an image of page 2 is formed on the second portion Y' thereof. The image of page 3 on the first portion X' is printed, by transfer-printing, to the other surface of the first copy sheet 64 fed from the first intermediate tray 74, and the printed copy sheet 64 is ejected onto the copy sheet ejecting tray 78 and placed thereon in such a manner that the image of page 3 faces upwardly and the image of page 4 faces downwardly. Meanwhile the image of page on the second portion Y' is printed, by transfer-printing, on the second copy sheet 65 fed continuously immediately following the first copy sheet 64 from the copy sheet feeding tray 63, and the printed copy sheet 65 is delivered to the second intermediate tray 80.

The pages of the book original 50 are turned again, so that page 1 is located on the right side X of the plate 51 and page 0 (flyleaf) which need not be copied is located on the left side Y thereof. After forming an image of page 1 on the first portion X' of the drum 58 (no image is formed on the second portion Y'), the image of page 1 is printed, by transfer-printing, on the other surface of the second copy sheet 65 supplied from the second intermediate tray 80. The printed copy sheet 65 is ejected onto the copy sheet ejecting tray 78 and placed thereon in such a manner that the image of page 1 faces upwardly and the image of page 2 faces downwardly.

In this way, a bundle of duplicate copies shown in a lower portion of FIG. 15 is obtained which has the same order and arrangement of pages as the book original 5.

Copying of an Original from an Even-Number Page to an Odd-Number Page (Even-Odd)

Figures 16A, 16B, 16C:
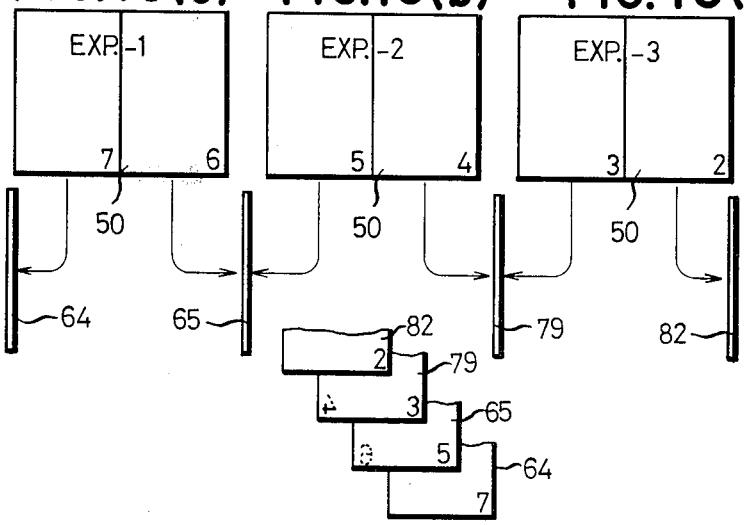

FIG. 16 shows an example in which a plurality of pages starting at an even-number page (page 2) and ending at an odd-number page (page 7) are copied. Copying processes for a unit of pages 7 and 6 and a unit of pages 5 and 4 are identical with those for a unit of pages 5 and 4 and a unit of pages 3 and 2 respectively which are shown in FIG. 14. When a last copying action shown in FIG. 16 is performed, page 3 is located on the right side X of the plate 51 and page 2 is located on the left side Y thereof, an image of page 3 is formed on the first portion X' of the drum 68 and an image of page 2 is formed on the second portion Y' thereof. As in last copying action of the example shown in FIG. 14, the image of page 3 on the first portion X' is printed, by transfer-printing, on the third copy sheet 79 supplied from the second intermediate tray 80, and the printed copy sheet 79 is ejected onto the copy sheet ejecting tray 78 and placed thereon in such a manner that the image of page 3 faces upwardly. Meanwhile the image of page 2 on the second portion Y' is printed, by transfer-printing, on the fourth copy sheet 82 which is fed continuously immediately following the third copy sheet 79 to the drum 58, and the printed copy sheet 82 is ejected onto the copy sheet ejecting tray 78. In this way, a bundle of duplicate copies shown in a lower portion of FIG. 16 is obtained which has the same order of pages as the book original 50.

When the pages are printed as aforementioned, pages 2 and 3 of the duplicates are not of the same arrangement as those of the book original 50. This defect can be eliminated if, as described previously by referring to FIG. 12, the fourth copy sheet 82 is delivered temporarily to one of the first intermediate trays 74 instead of being ejected direct after the image of page 2 on the drum 58 is printed thereon, and if the fourth copy sheet 82 is ejected to the copy sheet ejecting tray 78 after being fed to the drum 58 again. By following this process, it is possible to obtain a bundle of duplicate copies which has the same order and arrangement of pages as the book original 50.

Copying of an Original from an Even-Number Page to an Even-Number Page (Even-Even)

Figures 17A, 17B, 17C:
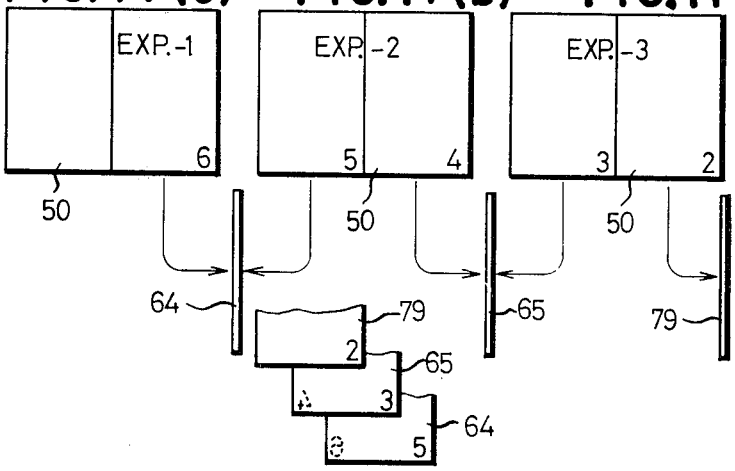

FIG. 17 shows an example in which a plurality of pages starting at an even-number page (page 2) and ending at an even-number page (page 6) are copied. In this example, a unit of page 6 and a unit of pages 5 and4 can be copied in the same processes as used in copying a unit of page 4 and a unit of pages 2 and 3 shown in FIG. 15. Also, a unit of pages 3 and 2 shown in FIG. 17 can be copied in the same process as used in copying pages 3 and 2 shown in FIG. 16. By feeding the final or third copy sheet 79 to the drum through the medium of the intermediate tray, it is possible to obtain a bundle of duplicate copies which is in complete agreement with the book original 50 in the arrangement and order of pages, in contrast to a bundle of duplicate copies shown in a lower portion of FIG. 17 which slightly differs in the arrangement of pages from the book original 50.

In copying a right-side-bound book original as described in detail hereinabove, a repeat performance can be carried out in the same manner as copying a left-side-bound book.

In the first and second embodiments of the invention described above, a book original has been described as being placed on an original placing glass plate in such a manner that the top of the book original is remote from the operator, regardless of whether the book original is a right-side-bound book or a left-side-bound book. However, it is to be understood that the invention is not limited to this manner of placing a book original, and that a book original may be placed on the original placing glass plate in such a manner that it is located upside down or with the bottom thereof remote from the operator. When this is the case, a bundle of duplicate copies having the same order and arrangement of pages as the book original can be obtained, if the order in which the pages of each unit of the open book original are scanned for illumination is reversed in all the examples of copying pages of odd-odd, odd-even, even-odd and even-even combinations and if switching means and copy sheet feeding timing are controlled according to the reversed order of illumination of the pages.

In the description of the embodiments described hereinabove, examples of copying a book original of different types having different combinations of pages have been set forth. When an original other than a book original or an original in the form of a sheet is desired to be copied, a copy sheet may be printed with an image of an original on one surface alone or with images of originals on opposite surfaces thereof. When an image is printed only on one surface, the copy sheet may be immediately ejected from the copying apparatus after the image is printed and fixed. When an image is printed on either surface, the copy sheet may be temporarily introduced, after an image is printed on one surface, into one of the first and second intermediate trays of the copying apparatus and then the copy sheet may be fed to the photosensitive drum again to print an image on the other surface of the copy sheet.

In FIG. 9, a second copy sheet feeding device 83 is provided. The second copysheet feeding device 83 is intended to store thereon a stack of copy sheets which differ in size from the copy sheets piled on the main copy sheet feeding device 61. Copy sheets of a smaller size may, for example, be piled in the second copy sheet feeding device, and copy sheets may be selectively fed from the main and second copy sheet feeding devices 61 and 83 depending on the size of the book original 50.

As described hereinabove, in the second embodiment of the invention, a bundle of duplicates having the same order of pages as the book original 50 can be obtained, if two pages of the open book original 50 forming a unit are continuously scanned by the light source 53 in one direction to illuminate the two pages when the two pages are desired to be copied and to continuously form images of the two pages on the photosensitive drum 38, and if the images of the two pages are each printed on one surface of two separate copy sheets by suitably controlling the actuation of the two switching guide plates. When the last copy sheet is printed with an image of a page only on one surface, a bundle of duplicate copies obtained will have the same order and arrangement of pages as the book original 50 (See FIGS. 12, 13, 16 and 17), if the last copy sheet is temporarily introduced into the intermediate copy sheet feeding device after an image of the page is printed on one surface thereof and then fed again to the photosensitive drum from the intermediate copy sheet feeding device so as to turn the copy sheet upside down. Control of the selective actuation of the switching guide plates can be effected by using a suitable control means. Therefore, the manner of controlling the switching guide plates will not be described in detail. However, one example of the control device which is cpable of enabling the second embodiment of the control method in conformity with the invention to be carried into practice with satisfactory results will be outlined hereinafter.

Figure 18:
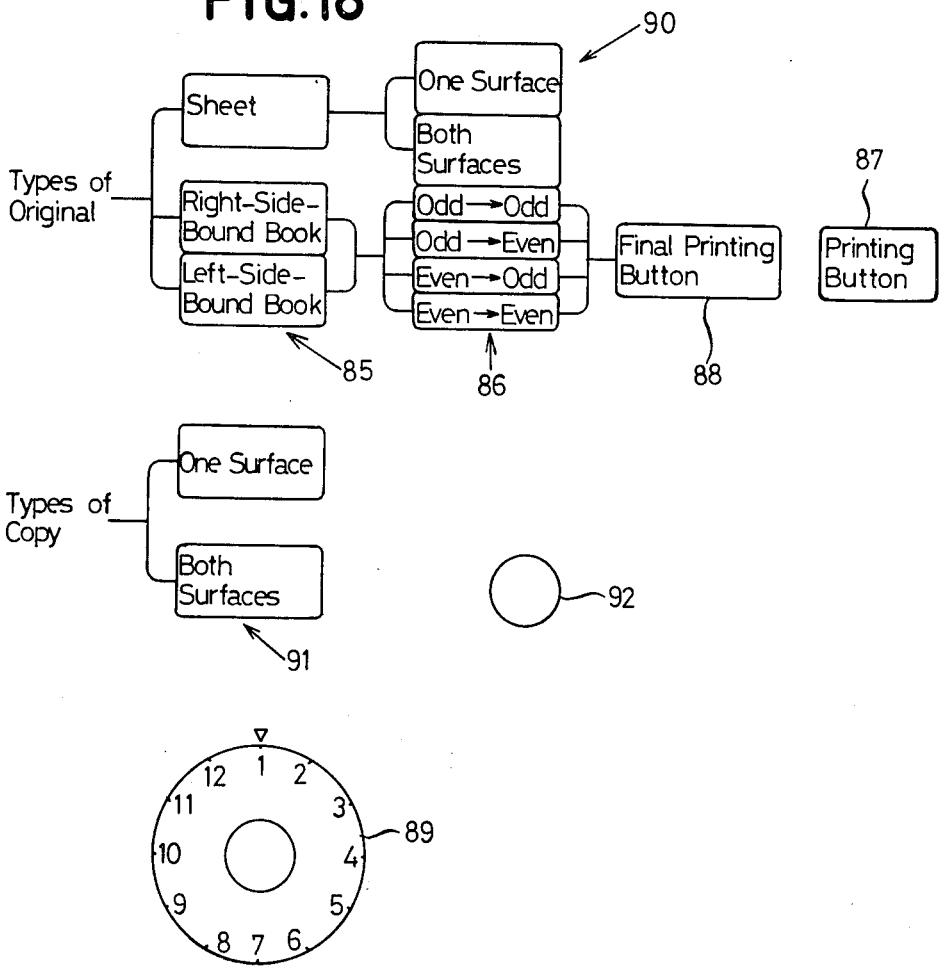
FIG. 18 shows an example of the operating buttons of the copying apparatus shown in FIG. 9.

As shown in FIG. 9, an instrument or control panel 84 for the control device is mounted in a suitable position of the copying apparatus. Like the instrument panel 24 of the first embodiment, the instrument panel 84 has mounted thereon, as shown in FIG. 18, original type selection switches 85 including original type (sheet or book original) selection switches and binding side (left-side or right-side) selection switches, and copied page combination selection switches 86 including "odd-odd", "odd-even", "even-odd" and "even-even" switches. In addition, a printing button 87, a final printing button 88, a repeat dial 89, single surface-both surfaces selection switches 90 used in copying a sheet original, single surface-both surfaces selection switches 91 used in copying a book original, copy sheet size changing switches (not shown) and an illumination termination indication light 92.

Figure 19:
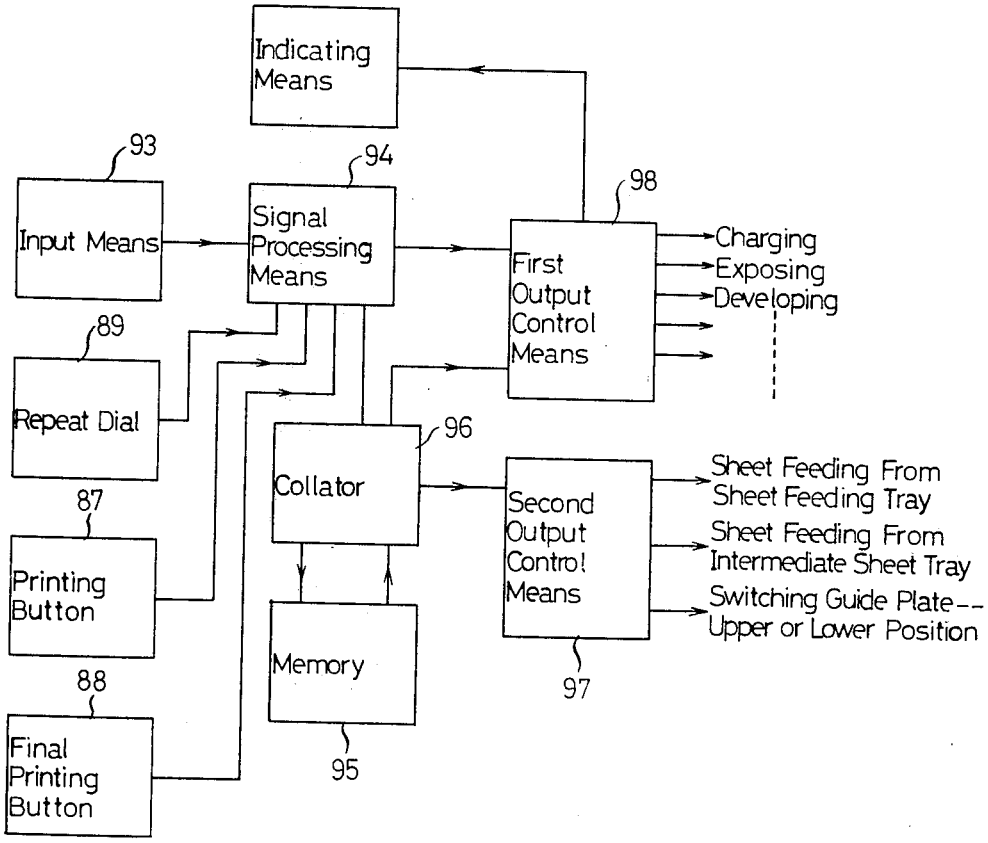
FIG. 19 is a block diagram of the basic components of the control device of the second embodiment.

FIG. 19 is a diagram showing the basic component of the control device. The component shown in the figure are similar to those shown in FIG. 3(*b*) except that the data stored in the memory is adapted to carry out the second embodiment of the control method. FIG. 19 shows input means 93 which include the original type selection switches 85, copied page combination switches 86, single surface-both surfaces selection switches 90,91 and copy sheet size changing switches. Instructions from the final printing button 88, printing button 87, repeat dial 89 and other parts of the input means are supplied to signal processing means 94. 95 designates a memory which is stored therein data with regard to the copy sheet feeding timing from copy sheet feeding device 61 and 83, the copy sheet feeding timing from the two intermediate trays 74, 80, directions in which the switching guide plates 69, 72 are moved and final printing process and other data. Each time one of the printing button 87 and final printing button 88 is pressed, a program to be carried out is retrieved through collator 96 from the memory 95 and supplied to second output control means 97. The signal processing means 94 performs the functions of amplifying, counting, damping, etc., and causes a series of copying processes including charging, exposure, developing, fixing and transfer-printing to be performed through first output control means 98, upon one of the printing buttons 87 and 88 being depressed.

By using the control device constructed as aforesaid, control of actuation of the switching guide plates 69, 72 and copy sheet feeding timing can be effected automatically in accordance with a selected combination of pages of a book original to be copied. For example, an operation for copying pages of the odd-odd combination shown in FIG. 10 will be described. As aforesaid, pages 4 and 5 are placed on the original placing glass plate 51, and then the repeat dial 89 is set at a desired number of times of repeat performance and one of the copy saheet size selection switches is actuated. Thereafter "Left-Side-Bound" button of the selection switches 85 and the "Odd-Odd" button of the copied page combination selection switches 86 are depressed. Finally the "Both Sides" button of the selection switches 91 is depressed and the printing button 87 is depressed. These instructions are transmitted to the signal processing means 94, and a series of printing processes are performed as desired, and at the same time a program consistant with a desired action of the switching guide plate 69 and/or 72 and a desired timing for copy sheet feeding is retrieved from the memory 95 through the collator 96, so that the desired operation of the switching guide plates 69 and/or 72 and the desired copy sheet feeding action are performed.

Upon completion of the series of copying processes for pages 4 and 5, the indication light 92 is turned on, informing the operator that copying of pages 4 and 5 is completed. Thus the operator learns that the book original should be opened at pages 2 and 3. In copying pages 2 and 3, the operator has only to press the printing button 87 after turning the pages, because the copying processes are automatically performed. When the final copying or copying of pages 0 and 1 is carried out, the final printing button 88 is depressed to retrieve a predetermined program from the memory 95, so that the aforementioned predetermined control action can be performed. The final printing button 88 is provided for the purpose of avoiding the copying of a page which need not be printed. That is, when the two pages forming a unit include a page which need not be copied (page 0 in the example shown in FIG. 10), copying of page 0 is not carried out because the memory 95 contains data for prohibiting the copying of page 0.

In place of the copied page combination selection switches 86, a 10-key button system (having buttons representing digits of 0 to 9 as provided in a desk-top calculator or push-button telephone) may be used. When this system is used, the digit of the first page to be copied and the digit of the final page to be copied are inputed and stored in the memory 95, so that one of the four combinations of pages or "Odd-Odd", "Odd-Even", "Even-Odd" and "Even-Even" can be selected by the difference between the two digits. Also, changeover of the various mechanisms can be automatically effected in effecting copying of only one of the two pages of the first and last units. This construction enables elimination of the final printing button 88, with a result that instructions can be given on initiation of all the types of copying operations by using only the printing button 87. A series of aforesaid actions can be performed if, in copying a sheet original, a "Sheet" button of the sheet selection switches 85 and either one of "Both Surfaces" and "Single Surface" buttons of the copied page combination selection switches 90 are pressed, and then the printing button 87 is pressed.

As described hereinabove in detail, the second embodiment of the invention enables a bundle of duplicate copies having the same order and arrangement of pages as the desired pages of a book type original to be automatically obtained by a simple manipulation, if the adjacent two pages of the book copy are illuminated and the photosensitive drum is exposed to optical images of the two pages, when it is necessary to copy the two pages of the two pages on the surface of the photosensitive drum, if the images of these pages are printed on separate copy sheets, and if the switching means are actuated in accordance with the selected copied page combination.

The embodiments of the invention permit not only a book original but also a sheet original to be copied without any trouble. As described in explaining the embodiments, a repeat performance can be carried out in accordance with a multiple copy process. If a repeat performance is carried out, turning of the pages can be carried out by the operator with ample time on hand. Even if the two pages at which a book original is opened contain a page which need not be copied (page 0 in FIG. 10 and page 5 in FIG. 11, for example), the apparatus can be operated without moving the book original on the original placing glass plate. Thus an original can be handled in the same manner at all times, so that the copying operation can be simplified and misoperation can be avoided.

It is to be understood that the control method according to the invention can be carried into practice by using other copying apparatus than those shown in FIGS. 2 and 9. Such copying apparatus would include one of the type in which the optical system remains stationary and the original placing glass plate moves, or one of the type in which copy sheets are obtained by cutting a strip in roll form into a plurality of sheets of a desired size. Also, copying can be carried out by adopting combinations of pages other than the combinations described in aforesaid the two embodiments. When no repeat performance is carried out, a copying apparatus used for carrying the control process according to second embodiment may have only one intermediate copy sheet feeding device.

What is claimed is:

1. A method for sequentially copying a plurality of successive pages of a book original on a copying apparatus capable of printing images of pages on both sides of a copy sheet comprising the steps of opening the book original at the desired pages and placing said open book faced downwardly on the original placing plate of a copying apparatus, inputting a selected page signal to the copying apparatus depending upon whether the first page and last pages of the desired sequence of pages of the book original to be copied is an odd-number or even number, inputting a book binding signal to the copying apparatus depending on whether the book original is a left bound book or a right bound book, and controlling the timing for feeding the copy sheets in accordance with the selected page signal input to said copy machine whereby a page image is printed on one side only of the first copy and both sides of all the succeeding copy sheets when said first and last page to be copied is odd-odd or even-even respectively and whereby a page image is printed on either side of all copy sheets when the first and last pages to be copies is odd-even or even-odd respectively.

2. A method as defined in claim 1 wherein the printing of an image on a copy sheet is effected by transfer printing each of the two pages at which the book original is opened.

3. A method as defined in claim 1 and including the step of continuously scanning the two pages at which the book original is opened for continuously copying said two pages whereby the images of said two pages are printed on the surface of separate successive copy sheets.

4. A method as defined in claim 3 wherein the first copy sheet has an image of a page printed only on one side thereof, and ejecting said final copy in an upside down position so that the sequence of the copied pages follow the page sequence of the book original.

5. A method for sequentially copying a plurality of successive pages of a book original on a copying apparatus capable of printing images of pages on both sides of a copy sheet comprising the steps of opening the book original at the desired pages and placing said open book faced downwardly on the original placing plate of a copying apparatus, inputting a selected page signal to the copying apparatus depending upon whether the first page and last pages of the desired sequence of pages of the book original to be copied is an odd-number or even number, inputting a book binding signal to the copying apparatus depending on whether the book original is a left bound book or a right bound book, and controlling the timing for feeding the copy sheets in accordance with the selected page signal input to said copy machine whereby an image is printed on one surface only of a first copy sheet and on both surfaces of all the rest of the copy sheets when the selected page signal is odd-odd; and as page image is printed on both sides of all the copy sheets when the selected page signal is odd-even, and a page image is printed on one surface only of the first and last copy sheets and on both sides of all other copy sheets when the selected page signal is even-odd, and a page image is printed on one surface only of a last copy sheet and on both surfaces of all the other copy sheets when the selected page signal is even-even.

6. A method as defined in claim 5 wherein the printing of an image on a copy sheet is effected by transfer printing each of the two pages at which the book original is opened.

7. A method as defined in claim 5 and including the step of continuously scanning the two pages at which the book original is opened for continuously copying said two pages whereby the images of said two pages are printed on the surface of separate successive copy sheets.

8. A method as defined in claim 7 wherein the final copy sheet has an image of a page printed only on one side thereof, and ejecting said final copy in an upside-down position so that the sequence of the copied pages follow the page sequence of the book original.

9. A copy apparatus for sequentially copying the successive pages of a book so that the copied page is printed on one or both sides of a copy sheet comprising an original placing plate on which an opened book original is placed to expose two pages thereof, an illuminating optical system for scanning the opened pages of said book, a photosensitive drum operatively disposed relative to said optical system, means for charging said drum whereby a latent image of said two pages is formed on said drum as said optical system scans said pages, means for developing the respective images of said two pages on said drum, copy sheet feed means for containing a supply of copy sheets, means for timing the feeding of a copy sheet into transfer printing relationship to said drum to effect the transfer printing of said developed image of one of said pages onto said copy sheet, fixing means for fixing said printed image on said copy sheet, ejection means including a discharge tray for receiving successive copy sheets which have been finally printed, an intermediate copy sheet feeding means disposed between said fixing means and said ejecting means, switching guide means operatively associated with said ejection means for directing a copy sheet to either said discharge tray or intermediate copy sheet feeding means depending upon whether a page image is to be printed on one side or both sides of the same copy sheet, means for timing the feeding of the copy sheet received at the intermediate copy sheet feeding means into transfer printing relationship to said drum to effect the transfer printing of the other page image on said drum onto said copy sheet feeding from said intermediate copy feed means, and selective control means for inputting a signal to said apparatus as to whether the book original is a left bounded or right bounded book.

10. A copying apparatus as defined in claim 9 and including a page classification selecting switch means for inputting a page combination signal into said apparatus depending upon whether the first page and last of the successive pages to be printed in sequence is an odd-number or even-number.

11. A copy apparatus for sequentially copying the successive pages of a book so that the copied page is printed on one or both sides of a copy sheet comprising an original placing plate on which an opened book original is placed to expose two pages thereof, an illuminating optical system for scanning the opened pages of said book, a photosensitive drum operatively disposed relative to said optical system, means for charging said drum whereby a latent image of said two pages is formed on said drum as said optical system scans said pages, means for developing the respective images of said two pages on said drum, copy sheet feed means for containing a supply of copy sheets, means for timing the feeding of a copy sheet into transfer printing relationship to said drum to effect the transfer printing of said developed image of one of said pages onto said copy sheet, fixing means for fixing said printed image on said copy sheet, ejection means including a discharge tray for receiving successive copy sheets which have been finally printed, an intermediate copy sheet feeding means disposed between said fixing means and said ejecting means, switching guide means operatively associated with said ejection means for directing a copy sheet to either said discharge tray or intermediate copy sheet feeding means depending upon whether a page image is to be printed on one side or both sides of the same copy sheet, means for timing the feeding of the copy sheet received at the intermediate copy sheet feeding means into transfer printing relationship to said drum to effect the transfer printing of the other page image on said drum onto said copy sheet feeding from said intermediate copy feed means, second intermediate copy sheet feeding means, and second switching guide means operative to direct a copy sheet alternately to either said first mentioned or second intermediate copy sheet feeding means.

12. A copying apparatus as defined in claim 11 and including a second copy feed means for containing a suply of copy sheets different in size from the size of copy sheets on said first mentioned copy feed means.

13. A copying apparatus as defined in claim 11 and including detecting means operatively associated with said second switching guide means for detecting a copy sheet thereat, and feeding means rendered responsive to said detecting means for feeding said copy sheet detected by said detecting means to either said first or second intermediate copy sheet feeding means depending upon the position of said second switching guide means.

* * * * *